US005295808A

United States Patent [19]

Machida et al.

[11] Patent Number: 5,295,808

[45] Date of Patent: Mar. 22, 1994

[54] SYNCHRONOUS ROTATING TYPE SCROLL FLUID MACHINE

[75] Inventors: Shigeru Machida, Iwamamachi; Hiroshi Iwata, Odawara; Isamu Tsubono, Chiyodamachi; Kazutaka Suefuji, Shimizu; Seiji Ohtake, Tsuchiura; Kenji Tojo, Moriyamachi, all of Japan

[73] Assignee: Hitachi, Ltd., Tokyo, Japan

[21] Appl. No.: 859,860

[22] Filed: Mar. 30, 1992

[30] Foreign Application Priority Data

Mar. 29, 1991 [JP] Japan ..... 3-066019
Jun. 26, 1991 [JP] Japan ..... 3-154780

[51] Int. Cl.[5] ..... F04B 35/04; F04B 39/06; F01C 1/04; F01C 21/00

[52] U.S. Cl. ..... 417/366; 417/410 D; 418/15; 418/55.3; 418/55.5; 418/57; 418/188

[58] Field of Search ..... 418/15, 55.1, 55.3, 418/55.5, 57, 188; 417/366, 410 D

[56] References Cited

U.S. PATENT DOCUMENTS 801,182 10/1905 Creux .
4,846,639 7/1989 Morishita et al. ..... 418/55.5
5,100,307 3/1992 Arita et al. ..... 418/188

FOREIGN PATENT DOCUMENTS 55-96390 7/1980 Japan ..... 418/55.3
61-200391 9/1986 Japan .
64-302 1/1989 Japan .
1-200083 8/1989 Japan .
2-149783 6/1990 Japan .
2-227576 9/1990 Japan ..... 418/55.3
2-305390 12/1990 Japan ..... 418/55.3

*Primary Examiner*—John J. Vrablik
*Attorney, Agent, or Firm*—Evenson, McKeown, Edwards & Lenahan

[57] ABSTRACT

A synchronous rotating type scroll fluid machine has a first scroll member driven by a shaft of a first motor and having an end plate and a scroll wrap protruding from a surface of the scroll end plate, and a second scroll member driven by a shaft of a second motor and having a scroll end plate and a scroll wrap protruding from a surface of the scroll end plate. The machine further has a mounting structure for mounting the scroll members such that the axes of the scroll members are offset from each other and that said scroll wraps of the scroll members mesh with each other. Thrust balancing arrangements are provided for attaining a balance between the thrusting forces acting on each said scroll member, both at the mounting structure and said scroll members. The thrust balancing arrangement includes through-bores formed in the respective motor shafts and serving as passage bores for discharging a compressed gas. This arrangement also provides cooling effect as the compressed working gas functions as a cooling medium and, in addition, serves to suppress distortion of the scroll end plate of each scroll member.

8 Claims, 18 Drawing Sheets

SYNCHRONOUS ROTATING TYPE SCROLL FLUID MACHINE

BACKGROUND OF THE INVENTION

1. Field of the Invention

The present invention relates to a synchronous rotating type scroll member fluid machine of the type in which a pair of scroll members are synchronously rotated by corresponding motors so as to compress gas in a scroll member working chamber, which may be used as a compressor of a refrigerator or air conditioner.

2. Description of the Prior Art

Conventional scroll member fluid machines have been described in, for example, Japanese Patent Unexamined Publication Nos. 61-20391, 1-200083 and 2-149783.

Among the above conventional techniques, Japanese Patent Application Laid-Open No. 61-200391 discloses a vertical scroll member compressor which includes a fixed scroll member 1, an orbiting scroll member 2, a rotary shaft 3 provided with a crank shaft, a casing and so on, as shown in FIGS. 20 and 21. FIG. 20 is a partial cross-sectional view of an upper portion of the rotary shaft 3, and FIG. 21 is a partial cross-sectional view of a lower portion of the rotary shaft 3. Between the portions respectively shown in FIGS. 20 and 21 is disposed a motor (not shown). The interior of the rotary shaft 3 also serving as the motor shaft is made hollow, and a cylindrical member 4 is disposed in the hollow portion, by which a double cylindrical space is formed. A fitting 5 having an outlet and an inlet for a cooling water 6 is disposed at the lower end of the rotary shaft 3, and the cooling water 6 is circulated within the double cylindrical space so as to cool the motor or the like.

FIG. 22 shows the scroll member compressor disclosed in Japanese Patent Unexamined Publication No. 1-200083. In this scroll member compressor, a pair of scrolls 7 and 8 in a casing C are respectively coupled to motor shafts 9 and 10 rotatably supported by the casing C, which are respectively rotated by first and second motors 11 and 12 fixed to the casing C. Sensors 13 and 14 are provided so as to detect the rotating state of the two rotary shafts 9 and 10. A control device 16 drives a third motor 15 on the basis of the signals obtained by the sensors 13 and 14 such that the rotational phase difference between the two rotary shafts 9 and 10 is reduced. A space 17 within the casing C forms a suction chamber. The interior of the motor shaft 9 is made hollow, and the hollow portion forms a discharge flow passage 18 partially having a discharge port 18'. A gas which enters the casing C in the manner indicated by arrow A is sucked from the scroll member outer peripheral portion and is compressed as it moves toward the center of the scroll member. A resultant high-pressure gas passes through the discharge flow passage 18 in the motor shaft 9 and then the discharge port 18' and is discharged outside of the compressor.

FIG. 23 shows the scroll member compressor disclosed in Japanese Patent Unexamined Publication No. 2-149783. This scroll member compressor has a pair of rotatable scroll members 7 and 8. The scroll member 8 is coupled to a motor shaft 19, and the other scroll member 7 is rotatable supported by a shaft on a holder 20. Rotation of the scroll member 8 driven by the motor shaft 19 rotates the scroll member 7 through an Oldham's mechanism 20'. A compression mechanism portion, including the scrolls 7 and 8, a motor 21 and a lubricating oil 43 are accommodated in a hermetic casing 22. A lower space where the motor 21 is accommodated forms a suction chamber space 23, and a space separated from the lower space by the holder 20 and a frame 25 serves as a discharge chamber space 24. The frame 25 for rotatably supporting the motor shaft has a flow passage 25' for the suction gas which is communicated with a suction space 29 on the scroll member outer peripheral portion. In the center of the scroll member 7 is provided a rotary shaft 26 having a discharge flow passage, which is opened to the discharge space 24 at the end portion of the rotary shaft 26. The rotary shaft 26 is rotatably supported on the holder 20. Between the holder 20 and the scroll member 7 is provided a back pressure chamber 27 in which the discharge gas is led from the discharge space 24 in a sealing state. The gas force in the back pressure chamber 27 and the thrust gas force in the compression working chamber formed by the two scroll member meet with each other. The back pressure space 27 and the suction space 29 located on the outer side of the suction space 27 are separated from and sealed to each other by a projecting portion 28 provided on the holder 20.

The aforementioned conventional scroll member compressors have the above structure so as to provide the following drawbacks. In the technique disclosed in, for example, Japanese Patent Unexamined Publication No. 61-200391, the cooling water 6, which is different from the working gas, is supplied into the inner space of the double cylindrical portion 4 provided in such a manner that it passes through the motor shaft 3. The supplied cooling water is returned through the outer space of the double cylindrical portion 4. Consequently, in a normal operating state, the motor can be effectively cooled from inner side thereof. However, in order to maintain the motor temperature to an appropriate value when the load applied to the motor changes to a great degree, the amount of cooling water must be controlled by providing a valve (not shown), such as a throttle valve, in the cooling water pipe and by opening or closing the opening thereof according to the load applied to the motor. To control the flow rate of the cooling water according to the load and thereby maintain the motor temperature to an appropriate value, i.e., to automatically change the motor cooling ability according to the load applied to the motor or cooling the motor by the working gas which flows in the scroll member wrap, have not been given much consideration in the conventional technique.

Japanese Patent Unexamined Publication No. 1-200083 discloses the structure of discharge flow passage in the scroll member compressor of the type in which one pair of scrolls are rotated. However, the discharge flow passage is formed only in the motor shaft 9. Furthermore, the discharge flow passage is not formed so as to pass through the whole motor shaft 9. Thus, the motor cannot be cooled by the working gas, and consideration is not given fully to the cooling of the motor when the load to the motor varies. Furthermore, in the motor shaft 9, a reacting force to be exerted to the scroll member is generated due to flow of the high-pressure discharge gas. However, such a dynamic reaction is not generated in the other shaft because no flow passage is provided therein. Consequently, thrusts having different magnitudes are exerted to the two scrolls 7 and 8 and a thrust is thus exerted to the forward surface of the wrap of each of the scrolls. In that state, if the two scroll members are synchronously rotated at a high speed in that state, dynamic loss due to friction or burning of the wraps and hence disability of the operation of the compressor may occur. Thus, to achieve high-speed operation, balancing of the thrusts is essential. However, in the aforementioned conventional technique, no consideration is given to synchronous high-speed rotation of the two scroll members in a state wherein the thrusts exerted thereto are balanced.

In the technique disclosed in Japanese Patent Unexamined Publication No. 2-149783 in which the two scroll members are rotated by the single motor, the through-hole is formed in the driving shaft of one of the scroll members, and the technique for balancing the thrusts exerted to the scroll members has been proposed. That is, in order to obtain such balanced thrusts, the back pressure space 27 is provided between the scroll member 7 and the holder 20 and a discharge gas is led into the back pressure space 27. However, since the back pressure space 27 has a fixed area and the inner pressure thereof is the discharge pressure, the thrust exerted to the scroll member 7 is fixed. Thus, when the thrust in the compression chamber varies due to changes in the suction pressure, the inner pressure of the back pressure space and the pressure in the compression working chamber may be imbalanced. It is thus difficult to always obtain desired thrusts. Furthermore, the sealing portion 28 is disposed on the rear surface of the rotary scroll member 7 to separate the back pressure space 27 from the suction pressure in the outer peripheral portion of the scroll member. However, this sealing is performed between the scroll member 7 which is a rotary member and the holder 20 which is a stationary member, and gas leakage cannot thus be avoided. The leaking gas is mixed into the suction gas, thus reducing the flow rate thereof and hence deteriorating the performance of the compressor. The amount of gas which leaks may be reduced by increasing the contact pressure of the sealing portion 28. However, in that case, frictional loss due to sliding increases as the rotational speed increases, and the performance of the compressor is thus deteriorated. Furthermore, in this technique, since one of the scroll members is rotated by the motor while the other scroll member is rotated by means of the Oldham's mechanism 20' disposed between the two scroll members, when the suction pressure changes and the thrust is exerted to the Oldham's mechanism 20', a frictional loss increases.

Another conventional synchronous rotating type scroll member fluid machines are disclosed in, for example, Japanese Patent Unexamined Publication No. 64-302. In the first scroll member of this fluid machine, a drive member for rotating a second scroll member is slidably disposed on the rear surface of the end plate of the first scroll member opposite to a vertical surface for providing the wrap in addition to the rotary shaft, and only the scroll member wrap is provided on the front surface of the end plate of the first scroll member. In the conventional technique disclosed in, for example, Japanese Patent Unexamined Publication No. 1-267379, a drive member for rotating the second scroll member is slidably disposed between the scroll end plates of the first and second scroll members, and only the motor shaft is provided on the rear surface of the end plate of the first scroll member opposite to the surface in which the wrap is vertically provided.

In the aforementioned conventional synchronous rotating type scroll member fluid machines, since the scroll member is rotated, a centrifugal force is exerted to the scroll member wrap, deforming the wrap outwardly in the radial direction. The force and deformation thereof increase as the distance from the center of the wrap increases. Since the end plate and the scroll member wraps are formed as one unit in the scroll member, the centrifugal force generated by the scroll wrap acts to the scroll end plate as a moment load. In the aforementioned conventional techniques, since the outer peripheral portion of the scroll end plate of each of the scroll members is not supported in the thrust direction, the scroll end plate may be deformed by the moment load in an arc in which the wrap side surface thereof is protruded outerward thereof. In that case of generating such a deformation, the two scroll end plates move closer to each other at the central portion of the scroll members, increasing the slide frictional loss which may lead to contact of the end plates in the worst case. Furthermore, since the outer peripheral portions of the end plates move away from each other, the gap in the axial direction between the scroll member wrap and the surface of the scroll end plate increases, while the gap in the radial direction between the side portions of the two scroll wraps becomes non-uniform. This may lead to contact of the side surfaces of the scroll wraps. In the aforementioned conventional techniques, as the rotational speed of the scroll members increases, the possibility of the deformation increases, thus increasing contact between the scroll members. Consequently, vibrations and noise levels are increased and damage to the parts is generated. These deteriorate reliability of the compressor.

An increase in the gap between the scroll wraps is mainly caused by the scroll end plate rather than the scroll wraps themselves. Hence, a thicker and more rigid end plate may be used to decrease the deformation thereof and thereby decrease the gap between the scroll wraps. However, the scroll end plate has a disk-like form and is hence less rigid against an out-of-plane force applied thereto. Therefore, it must have a large thickness as compared with the wrap. In that case, however, the weight and, hence, inertial mass of the scroll member is increased, and the scroll member may not follow rotation of the motor excellently when the motor is activated or stopped. This makes synchronous rotation of the motors difficult.

SUMMARY OF THE INVENTION

In view of the problems described above, an object of the present invention is to provide a synchronous rotating type scroll member fluid machine in which two scrolls, which are driven by respective drive motors, can operate with a good balance of thrust forces acting thereon, so as to reduce mechanical loss, thus attaining high efficiency over a wide range of operation from low- to high-speed range.

Another object of the present invention is to provide a synchronous rotating type scroll member fluid machine which has a simplified construction, a small size and a light weight, and which can operate with reduced noise and vibration even at high speed of operation.

A further object of the present invention is to provide a synchronous rotating type scroll member fluid machine in which motors are automatically and adequately cooled in accordance with the loading conditions by making an efficient use of the working gas applied to the machine.

Yet another object of the present invention is to provide a synchronous rotating scroll member fluid machine in which distortion of the end plate of each scroll member is diminished to optimize the size of the gap between the wraps of both scroll members.

Still further object of the present invention is to provide a synchronous rotating type scroll member fluid machine which can be incorporated in a refrigeration cycle suitable for performing air-conditioning in couple of rooms.

To these ends, according to the present invention, there is provided a synchronous rotating scroll member fluid machine, comprising: a first scroll member driven by a shaft of a first motor and having an end plate and a scroll member wrap protruding from a surface of the end plate and normal thereto; a second scroll member driven by a shaft of a second motor and having an end plate and a scroll member wrap protruding from a surface of the end plate and normal thereto; mounting means for mounting the scroll members in such a manner that the axes of the scroll members are offset from each other and that the wraps of the scroll members mesh with each other; and thrust balancing means for attaining a balance between the thrusting forces acting on each side of the scroll both at the mounting means and the scroll members in meshing state.

The thrust balancing means discharges, through a passage formed in the shaft of the motor for driving each scroll, the gas compressed between both scrolls, thereby attaining a balance between forces produced by the discharged gas.

The thrust balancing means is provided on the mounting means and/or on the scrolls. In the specific form of the invention, first and second motors for driving the first and second scrolls are disposed in hermetic spaces defined in the hermetic casing, the hermetic spaces communicating with each other through a communication passage formed in the hermetic casing.

In order to achieve the above object, a mechanical thrust bearing is provided for each of the scrolls, so as to act against a force which is produced by the compressed gas and which acts to move both scrolls away from each other.

In another form, a back pressure chamber for receiving an intermediate pressure is provided for each of the scrolls, so as to act against a force which is produced by the compressed gas and which acts to move both scrolls away from each other.

In a specific form of the invention, a frame disposed so as to face the end plate of each the scrolls is provided with annular grooves which receive, leaving predetermined gaps, annular projections formed on the reverse sides of the respective end plates, and the gaps are filled with a lubricating oil.

In another specific form of the invention, each scroll member is provided with a second thrust bearing which serves to limit movement of the scroll member from moving toward the other scroll member, the sum of the heights of the second thrust bearings on both scrolls being equal to or slightly greater than the axial height of the scroll member wrap.

To achieve the another object mentioned before, the invention provides a synchronous rotating type scroll member fluid machine which incorporates a rotational phase compensation mechanism disposed between each end plate and the portion of the frame facing the end plate.

In a specific form, a first rotational driving unit for supplying driving torque to the first scroll member and a second rotational driving unit for supplying driving torque to the second scroll member are coupled to respective scrolls by complying means for transmitting only rotating torque, for example, a spline-shaft coupling through rotary shafts, and are encased in a common hermetic vessel.

To achieve the further object of the present invention, the motor shafts for driving the scrolls are provided therein with axial through-bores which communicate with discharge ports formed in the centers of the end plates of respective scrolls, the axial through bores serving as flow passages for discharging compressed gas.

In a specific form of the invention, the end plate of the second scroll member has a radial communication bore which opens at its one end in a peripheral portion of the second scroll member and at its other end in the axial through bore formed in the motor shaft for driving the second scroll member. In this form of the invention, the through bore formed in the motor shaft for driving the second scroll member serves as a suction gas passage, while the axial through bore formed in the first motor shaft for driving the first scroll member functions as a gas discharge flow passage.

To achieve the yet another object, the synchronous rotating type scroll member fluid machine of the present invention has an annular projection provided on the reverse side of the end plate of each scroll member. The annular projection may be formed integrally with the end plate or may be formed as a separate member and attached to the end plate.

The radial position of the annular projection is suitably determined depending on the relationship between the moment load produced by the annular projection and the moment load produced by the scroll member wrap.

Preferably, the annular projection is formed of a material having a greater specific gravity than the scroll member.

In a specific form of the invention, the end plate of each scroll member is provided on the reverse side thereof with a first thrust bearing of a dynamic pressure type which suppresses movement of the scroll member away from the other scroll member, in addition to the above-mentioned annular projection.

In another specific form of the invention, the end plate of each scroll member is provided on the same side as the wrap thereof located normal to such a side of the end plates with a second thrust bearing which serves to suppress movement of the scroll member towards the other scroll member.

The outer peripheral surface of the annular projection provided on the reverse side of the end plate, integrally or as an attached member, is inclined or arcuate-shaped and is positioned so as to form a predetermined gap between itself and the opposing surface of the frame.

In a further specific form of the invention, the synchronous rotating scroll member type fluid machine has a connecting bar disposed between opposing surfaces of the first and second scrolls are rotatably connected to both scrolls so as to forcibly prevent deformation of the end plates of both scrolls.

To achieve the still further object, the present invention provides a synchronous rotating type scroll member fluid machine, comprising: first and second scrolls each having an end plate and a scroll member wrap protruding upright from one surface of the end plate; and a frame having portions disposed on opposite sides of the respective end plates to the wraps and rotatably supporting motor shafts for rotatingly driving the scrolls, the first and second scrolls being assembled together such that the scroll member wraps mesh with each other to define compression chambers, the first and second scrolls being synchronously rotated in the same direction through the motor shafts so as to compress a gas in the compression working chambers and to discharge the compressed gas, the synchronous rotating type scroll member fluid machine further comprising: discharge ports provided in the center of the rotary shafts; compression working chambers provided on both sides of the meshing scrolls; and spaces provided with the hermetic casing and communicated with the discharge ports being disposed at both sides of the scroll member, each of spaces being connected to the first heat exchanger, parts disposed so as to meet each flow from the first heat exchangers with each other and having a function of throttle valve at the following side of the flows, and second heat exchanger, thereby forming a refrigeration cycle.

In the present invention having features described above, the first and second scrolls are rotatingly driven in the same direction and at the similar speed by the shafts of the first and second motors, with the scrolls having an offset from each other and keeping their wraps in meshing engagement with each other. Consequently, at least one compression working chamber is formed between both scroll member wraps and this compression working chamber sucks the gas from the outer periphery portion of the scrolls and is progressively moved towards the center of the scrolls while progressively decreasing its volume. Consequently, the gas confined in the compression working chamber is progressively compressed and discharged through discharge ports formed in the central portions of both scrolls or a discharge port formed in the first scroll member. The gas flown therein is sucked through a suction passage formed around the scroll members or through a radial passage formed in the end plate of the second scroll member from the axial through-bore of the second motor shaft. The gas discharged from the central discharge ports of the scrolls is discharged to the exterior of the machine through the axial through-bores formed in the first and second motor shafts, or through the axial-though bore formed in the first motor shaft via the central discharge port of the first scroll member. In either case, thrust forces of the substantially same level are applied to both motor shafts and scrolls, so that these thrust forces cancel each other, thus eliminating any unidirectional biasing of the motor shafts and scrolls. Furthermore, the gas flowing through the motor shafts effectively cools the motors at a rate which corresponds to the level of the load imposed on these motors.

As shown in FIG. 13, in the synchronous rotating type scroll member fluid machine of the invention, each of the first scroll member and the second scroll member is power-driven to rotate about the axis of a motor shaft which engages with a shaft coupling 1*l*. As a result of the rotation, a centrifugal force $F_W$ is generated to act on the scroll member 1. In particular, the component of the centrifugal force $F_W$ acting on the scroll member wrap 1*b* serves to outwardly spread and incline the wall of the wrap. As a consequence, the end plate 1*a* of the scroll member 1 is acted by moment load $M_W$ and distorted such that it is convexed at the side thereof carrying the wrap. At the same time, a projection 1*k* formed on the reverse side, i.e., the side opposite to the wrap, of the end plate produces a centrifugal force $F_C$ as a result of rotation of the scroll member 1. This centrifugal force $F_C$ acts as the moment load $M_C$ on the end plate of the scrolls and serves to warp the end plate such that the end plate is concaved at its side carrying the wrap. Thus, the centrifugal forces $F_W$ and $F_C$ acting on both sides of the end plates produce moment loads $M_W$, $M_C$ on the end plate which cancel each other, thus diminishing the amount of distortion of the end plate.

When the level of the moment load $M_C$ produced by the mass of the projection 1*k* provided on each reverse side of the end plates is small than the moment load $M_W$ produced by the mass of the scroll member wrap 1*b*, the projection 1*k* is located at a radially outer portion or formed from a material which has a greater specific gravity. Conversely, when the level of the moment load $M_C$ produced by the mass of the projection 1*k* is large as compared with the level of the moment load $M_W$ generated by the mass of the scroll wrap, the level of the centrifugal force $F_C$ can be decreased by, for example, radially inwardly shifting the position of the projection 1*k*.

In the specific form of the invention in which first thrust bearings of dynamic-pressure type are provided on the reverse sides of the end plates of both scrolls so as to suppress movements of both scrolls towards each other, the thrust bearing capacity increases as the operation speed become higher, thus restricting the movements of both scrolls, so that the scrolls are held in correct positional relationship with each other.

In an embodiment of the present invention, as will be described later, the first thrust bearing is realized by using the pressure of the fluid. In this embodiment, the projection serves to maintain the fluid pressure at an optimum level, so as to enable the first thrust bearing to safely bear the thrust force acting on the scroll member.

In another specific form of the invention, second thrust bearings are provided on the wrap-carrying surfaces of the end plates of respective scrolls so as to project from these end plates, thereby suppressing displacement of both scrolls towards each other. These second thrust bearings serve to minimize the axial gap between the axial end of each wrap and the opposing surface of the end plate of the mating scroll member, without allowing the axial end surface to strongly contact with the end plate. The second thrust bearing also is effective in suppressing any warping tendency of the end plate, thus optimizing the radial gap between the wraps of both scrolls.

The annular projection provided on the reverse side of each scroll end plate, formed integrally therewith or formed separately and attached thereto, has a inclined or an arcuate outer peripheral surface which faces the opposing surface of the frame with a suitable gap left therebetween. The tapered surface resists any outward deformation of the projection caused by the centrifugal force, while preventing convexing of the scroll wrap-carrying surface of the end plate which may otherwise be caused by the component of the centrifugal force acting in the thrusting direction.

In the specific form of the present invention having the connecting bar provided between the opposing surfaces of the pair of scroll member end plates and rotatably connected to both scroll end plates so as to forcibly prevent any deformation of the scroll end plates, the connecting bar effectively suppresses any arch-like deformation of the whole end plate.

In the specific form of the invention in which annular grooves are formed in the frame facing the end plates so as to receive the annular projections, the groove being filed with a lubricating oil, the mating surfaces of the projection and the grove slide on each other, thus forming a slide bearing. Consequently, the annular grooves slidably support the associated annular projections, thus restricting deformation of the end plates. Furthermore, the lubricating oil confined in the annular groove provides a sealing effect which makes it possible to maintain different levels of pressure at both sides of the annular projection provided on the reverse side of each end plate. More specifically, high discharge pressure or an intermediate pressure is maintained at the radially inner side of the annular projection, while suction pressure is maintained at the radially outer side of this projection. Thus, the annular projection serves to prevent high- or intermediate-pressure fluid from rushing into the suction side, thus contributing to improvement in the performance of the scroll member fluid machine particularly when the latter is used as a compressor.

In the specific form of the invention in which the first and second scrolls are independently driven by respective drive units, it is possible to directly couple these drive units to the respective scrolls at a close proximity thereto and make unnecessary balance weight conventionally disposed thereon, so that the assembly precision is enhanced to ensure that optimum clearances are formed between both scroll member wraps both in the radial and axial directions. In addition, the construction of the driving system is simplified.

The axial heights of the second thrust bearings are so determined that the sum of these heights is substantially equal to or slightly greater than the axial height of the scroll member wrap. Therefore, the axial clearance between the axial end of each wrap and the opposing surface of the end plate of the other scroll member is optimized to offer a high efficiency of the machine.

The rotational phase compensation mechanism acting between each end plate and the portion of the frame opposing the end plate ensures that each scroll member can rotate without contacting the other scroll member. Consequently, vibration and noise are greatly reduced even at high speed of operation of the scroll member fluid machine.

In the specific form of the invention in which the first and second drive units for driving the first and second scrolls are coupled to the respective scrolls via rotary shafts by a spline-shaft coupling, it is possible to obtain a greater tolerance for the radial offset of the scroll member and the rotary shaft so as to facilitate machining of parts, thus reducing strictness of requirement for dimensional precision of the parts. In addition, assembly is facilitated because the drive shafts can be coupled after bringing both scroll members into meshing engagement with each other.

The invention also can be embodied as a synchronous rotating type scroll member fluid machine, comprising: first and second scroll members each having an end plate and a scroll member wrap protruding upright from one surface of said end plate; and a frame having portions disposed on opposite sides of the respective end plates to said wraps and rotatably supporting shafts for rotatingly driving said scrolls, said first and second scrolls being assembled together such that said scroll member wraps mesh with each other to define compression chambers, said first and second scrolls being synchronously rotated in the same direction around their geometrical axes so as to compress a gas in said compression chambers and to discharge the compressed gas, said synchronous rotating scroll member fluid machine further comprising: discharge ports provided in the center of said motor shafts; and compression chambers provided on both sides of the meshing scroll members, said discharge chambers being communicating with first heat exchangers the outlet sides of which being connected to a common second heat exchanger through orifice members having a function of a throttle valve, said first heat exchangers, second heat exchanger and said orifice members, thereby forming a refrigeration cycle. In this case, it is possible to dispose the first heat exchangers in different rooms, thus enabling air-conditioning in two separate rooms.

DETAILED DESCRIPTION OF THE PREFERRED EMBODIMENTS

Figure 1:
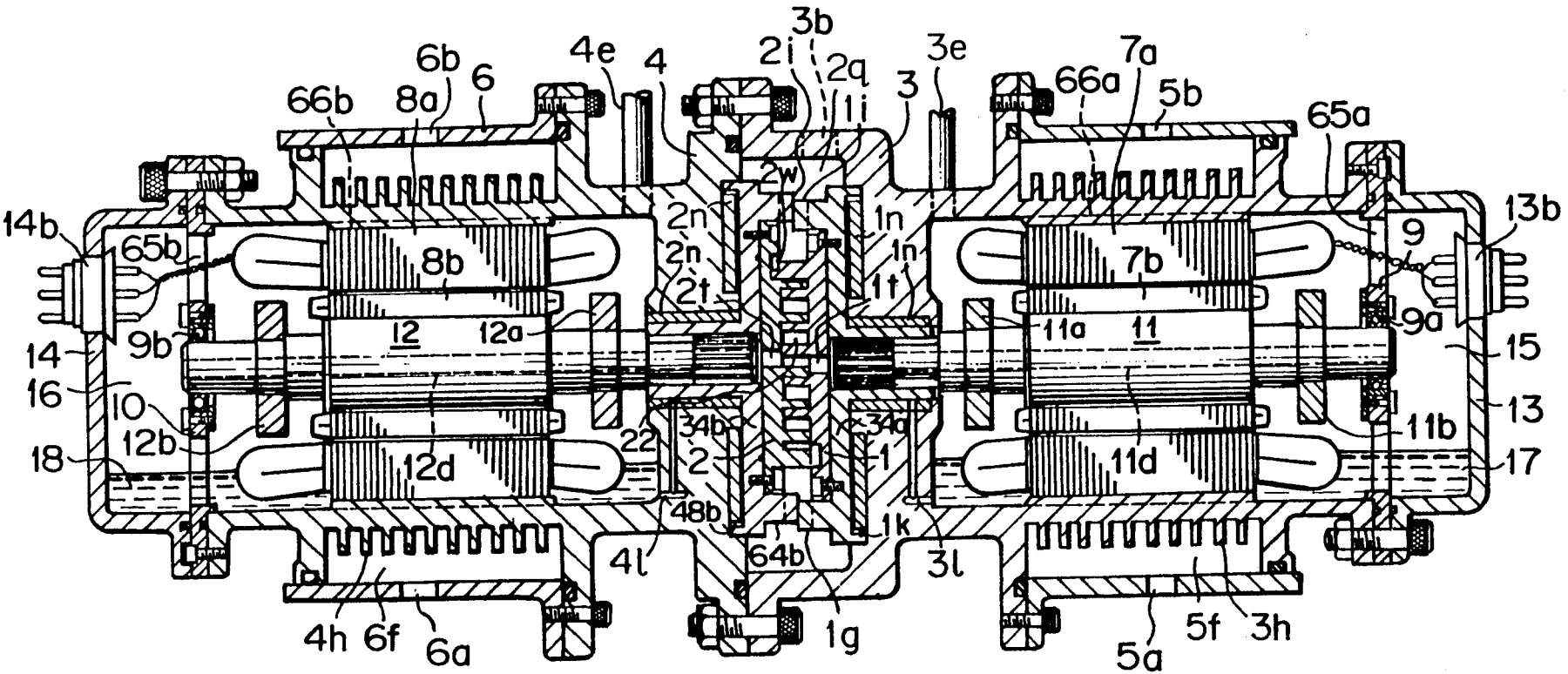
FIG. 1 a longitudinal cross-sectional view of a first embodiment of a synchronous rotating type scroll fluid machine according to the present invention.

FIG. 1 shows a first embodiment of a synchronous rotating type scroll member compressor according to the present invention. Detail of the structure thereof will be described below in connection with another embodiment. An end plate of a first scroll member 1 and an end plate of a second scroll member 2 respectively have discharge ports 1*t* and 2*t* at the central portion thereof. Straight first and second motor shafts 11 and 12 for respectively rotating the first and second scrolls 1 and 2 are respectively supported by bearings 9*a* and 9*b* and bearings 1*n* and 2*n* in such a manner that they respectively face the discharge ports 1*t* and 2*t*. The first and second motor shafts 11 and 12 extend in spaces 15 and 16 in hermetic casings 3 and 4, respectively. The motor shafts 11 and 12 respectively have in them through-holes 11*d* and 12*d* through which the discharge ports 1*t* and 2*t* respectively communicate with the spaces 15 and 16. The hermetic casings 3 and 4 respectively have discharge pipes 3*e* and 4*e* for a working fluid. The hermetic casings also have a suction port 3*b* at the central portion thereof. Projecting portions of second thrust hearing 1*g*, 2*g* provided on outer peripheral portions of supporting plates 34*a* and 34*b* for the first and second scrolls 1 and 2 have a plurality of suction passages 1*i* and 2*i* in the circumferential direction thereof, through which the suction port 3*a* is made to communicate with a compression working chamber 22 of the scroll member. The first and second scroll members 1 and 2 are respectively supported by mechanical dynamic pressure type thrust bearings 1*w*, 2*w*.

The synchronous rotating type scroll member compressor shown in FIG. 1 is operated as follows: when the first and second motor rotors 7*b* and 8*b* are rotated, the first and second scroll members 1 and 2 are thereby rotated, by which the working fluid enters a suction pressure space 19 from the suction port 3*b*, and then enters the compression working chamber, constituted by scroll member wraps, through the suction passages 1*i* and 2*i*. In the compression working chamber 22, the working fluid is compressed and thereby becomes a high-pressure gas. The high-pressure gas is discharged from the two discharge ports 1*t* and 2*t*. The discharged gas reaches the spaces 15 and 16 in the hermetic casings 3 and 4 through the through-holes 11*d* and 12*d* in the motor shafts 11 and 12. Thereafter, the high-pressure gas is discharged to the outside of the compressor through openings 65*a* and 65*b* formed in a bearing supporting plate 9, 10 or through a plurality of flow passages 66*a* and 66*b* provided in the outer peripheral portions of the motors. The high-pressure gas radiates heat while it flows from the spaces 15 and 16 in the hermetic casings 3 and 4 to the discharge pipes 3*e* and 4*e* and thereby cools the motor stators 7*a* and 8*a* and motor rotors 7*b* and 8*b*. Furthermore, the high-pressure gases which respectively come out of the discharge ports 1*t* and 2*t* apply the same level of thrust to the scroll members 1*a* and 2*a*, the motion of the first and second scroll members 1 and 2 can be made smooth against the thrust generated in the compression working chamber.

The structure and function of the synchronous rotating type scroll member compressor shown in FIG. 1 will be described below in further detail. In FIG. 1, reference characters 3 and 4 denote hermetic casings, 7*a* and 8*a* respectively denote stators of the first and second motors, and 7*b* and 8*b* respectively designate rotors of the first and second motors. Side casings 13 and 14 respectively having hermetic terminals 13*b* and 14*b* are respectively fixed to the hermetic casings 3 and 4 by means of tightening means, such as bolts. The hermetic terminals 13*b* and 14*b* are electrically connected to the coils of the stators of the first and second motors, respectively, so that power can be supplied to the motors from an external source. In the hermetic casings, hermetic spaces 5*f* and 6*f* are respectively formed on the periphery thereof. In the hermetic spaces 5*f* and 6*f*, fins 3*h* and 4*h* are respectively disposed. Cooling medium flows into the hermetic casings 3 and 4 from openings 5*a*, 5*b*, 6*a*, 6*b* to effectively cool the heat in the interiors of the hermetic casings 3 and 4.

The two hermetic casings 3 and 4 are fixed to each other by means of tightening means, such as bolts, outside of the first and second scrolls 1 and 2. The hermetic casings 3 and 4 have substantially the same structure except for the vicinity of the coupling portion. The motor shafts 11 and 12 of the first and second motors are respectively coupled to the motor rotors 7*b* and 8*b* by means of coupling means, such as shrinkage fitting. One end portions of the motor shafts 11 and 12 are rotatably supported by the bearings 9*a* and 10*a* fixed to the bearing support plates 9 and 10, respectively, while the other end portions thereof are rotatably supported by the plain bearings 1*n*, 2*n* fixed to the central portions of the hermetic casings 3 and 4 through the cylindrical bosses formed at the central portions of the disk-shaped scroll member support plates 34*a* and 34*b*, respectively. The motor shafts 11 and 12 respectively have in them the through-holes 11*d* and 12*d*. Near the two end surfaces of the motor rotors 7*b* and 8*b* are provided balancing rings 11*a*, 11*b*, 12*a* and 12*b* for dynamically balancing the motor shafts. The motor shafts 11 and 12 are coupled to the scroll member support plates 34*a* and 34*b* by means of, for example, spline couplings so as to allow the rotational torques of the motor shafts 11 and 12 to be sufficiently and respectively transmitted to the disk-shaped scroll member support plates 34*a* and 34*b*. The outer peripheral surfaces of the cylindrical bosses formed at the central portions and on the motor sides of the scroll member support plates 34*a* and 34*b* constitute the sliding surfaces which face the plain bearings 1*n* and 2*n*.

Figure 5:
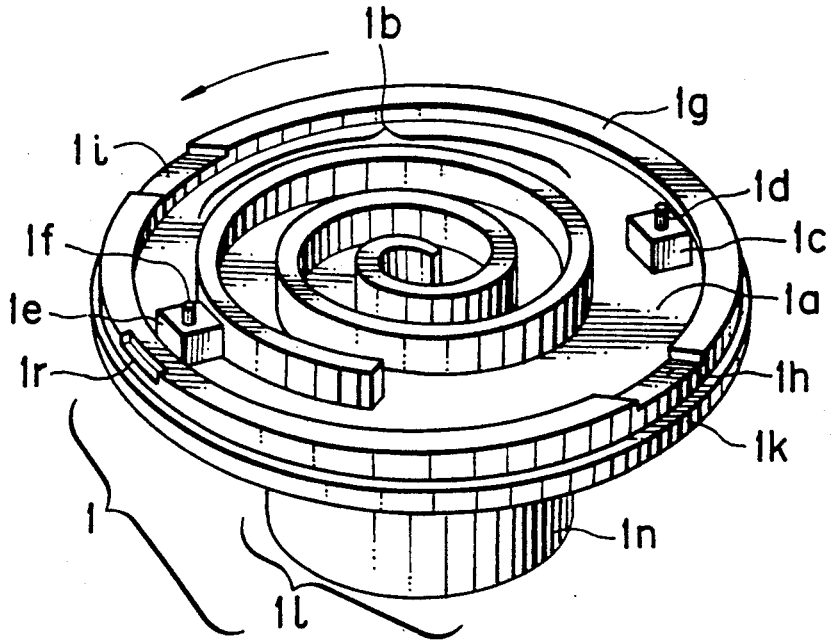
FIG. 5 is a perspective view of a first scroll member of the first or fourth embodiment according to the present invention.
Figure 6:
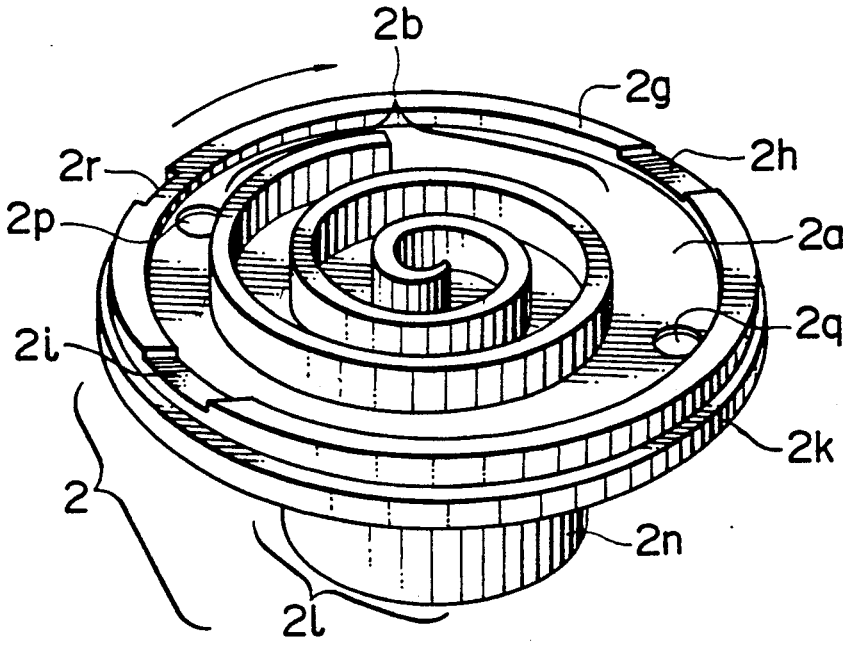
FIG. 6 is a perspective view of a second scroll member of the first or fourth embodiment.

Both of second thrust bearings 1*g*, 2*g* on the outer peripheral portions of the scroll member support plates 34*a* and 34*b* form a projecting surface. The scroll member support plates 34*a* and 34*b* are disposed such that the projecting outer peripheral portions thereof are substantially in contact with each other in the thrust direction. The second thrust bearing 1g and 2g have a plurality of suction flow passages 1i, 2i in the radial direction thereof. The first and second thrust bearings 1g, 2g form the compressor working chamber 22 with the first and second scroll members having the discharge holes 1t and 2t in the central portions thereof, are in engagement with each other with spiral wraps thereof facing each other by which the compression working chamber 22 is formed. The first scroll member 1 is fixed to the first scroll member support plate 34a by means of bolts at a position where the center of the first scroll member 1 is aligned with the center of the first motor shaft 11. The second scroll member 2 is fixed to the second scroll member support plate 34b by means of bolts in a state where the center of the second scroll member 2 is in alignment with the center of the second motor shaft 12 which is offset from the center of the first motor shaft 11 by a fixed distance. Thus, rotation of the two motor shafts 11 and 12 enables the pair of scroll members 1 and 2 to be rotated in the same direction in an eccentric fashion. The structure of rotary phase compensation means 1f and 2q, as shown in FIGS. 5 and 6, includes a pair of pins 1b, 1d provided on one of the scrolls at a position which deviates from the center of that scroll member in one direction, and a projection provided on the other scroll member at a position deviating from the center thereof in such a manner that it is interposed between a pair of pin holes 2p, 2q. The rotary phase compensation means has the function of limiting the rotary phase difference of the first and second scroll members 1 and 2 in a fixed range during the operation of the compressor.

The thrusts, generated in both the scroll members 1 and 2 by gas compression during the operation of the compressor, are respectively received by the first thrust bearings 1w and 2w respectively provided on the sides of the casings 3 and 4 which face the back surfaces of the scroll member support plates 24a and 34b. The first thrust bearings 1w and 2w may be annular flat plates with an oil film coated thereon, or dynamic groove bearings capable of generating a dynamic pressure when the member with which the bearing is in engagement is rotated. The rear surfaces of the outer peripheral portions of the scroll member support plates 34a and 34b respectively constitute projections 1k, 2k which prevent the high-pressure gas or a lubricating oil charged in the hermetic casings leaking into the suction pressure space 19 through the radial bearings 1n and 2n or the first thrust bearings 1w and 2w.

The operation of the scroll member compressor shown in FIG. 1 will now be described. When power is supplied from the hermetic terminals 13b and 14b, the first motor, constituted by the stator 7a and the rotor 7b, and the second motor, constituted by the stator 8a and the rotor 8b, rotate simultaneously, by which the first and second scrolls 1 and 2 simultaneously rotate. Thus, a refrigerant gas enters the suction pressure space 19 from the suction port 3b formed in the hermetic casing, and then enters the compression working chamber 22 through the suction flow passages 1i and 2i formed in the scroll member support plates 34a and 34b. In the compression working chamber 22, the refrigerant gas moves toward the center thereof, during which it is compressed. The resulting high-pressure gas is discharged into the spaces 15 and 16 in the hermetic casings 3 and 4 from the discharge ports 1t and 2t through the through-holes 11d and 12d respectively formed in the motor shafts 11 and 12. The high-pressure gas filling the spaces 15 and 16 is discharged outside the compressor through the openings 65a and 65b respectively formed in the bearing support plates 9 and 10 and the plurality of flow passages 66a and 66b formed in the outer peripheral portions of the motors from the discharge pipes 3e and 4e. During compression, a rotary phase difference larger than the allowable value may be generated between the two motors. However, this rotary phase difference is maintained within the permissible range by the rotary phase compensation means 1f and 2q, etc. The rotational phase compensation means 1f and 2q also maintains to minimize the radial gap between the scroll wraps. Also, the first thrust bearings 1w and 2w function and the scroll wraps are thereby kept close to each other in the axial direction against the thrust in the compression working chamber 22, by which the gap between the scroll wraps in the axial direction is maintained minute. A cooling medium is supplied into the peripheral hermetic space 5f and 6f separated from the hermetic casings 3 and 4 by a wall so as to appropriately absorb the heat of the motors and thereby cool the entirety of the compressor. The balance rings 11a, 11b, 12a and 12b are provided to dynamically balance the rotary system, such as the motor shafts 11 and 12. The imbalance obtained using a rotation balancing tester before assembly can be cancelled by cutting off the surfaces of these rings accordingly.

According to this embodiment, the discharge gas flow passages 11d and 12d are formed in the two motor shafts 11 and 12. As the rotational speed of the compressor increases, the load thereof increases, thus increasing the amount of heat of the motors. However, the flow rate of the discharge gas also increases, improving the cooling ability thereof and the temperature of the motors can thus be maintained to substantially a fixed value. Thus, the motor cooling ability varies depending on the operation conditions, that is, cooling of the motors by the discharge gas is self-controlled. Furthermore, since the same amount of thrust is exerted to the motor shafts 11 and 12 or the scroll members 1 and 2, the scroll members 1 and 2 are not pressed in one direction, and contact between the forward portions of the scroll wraps and the bottom surfaces thereof can thus be eliminated. Furthermore, since the motor shafts 11 and 12 have no crank portion, a centrifugal force due to the eccentric mass is not exerted thereto. Consequently, bearing loads are alleviated, and the mechanical frictional loss can thereby be reduced. This allows the performance of the compressor to be maintained high during the high-speed rotation. Furthermore, most of the motions of the motion parts is the rotary motion about the center of the rotation of the motors, and the compressor has no reciprocating motion parts. Consequently, low vibrations can be achieved in the high-speed operation. Furthermore, since the discharge flow passages 11d and 12d are provided within the two motor shafts 11, 12, a sufficient flow passage area can be provided compared with the discharge gas flow rate, and fluid resistance of the gas can thus be reduced. Although not shown, it may be arranged such that the discharge gas flow passage 11d, 12d is formed only in one of the motor shafts 11, 12. In that case, in the hermetic casing in which no discharge flow passage is formed in the motor shaft 11 or 12, it is possible to supply a larger amount of cooling medium in the peripheral hermetic space 5f (or 6f).

Figure 2:
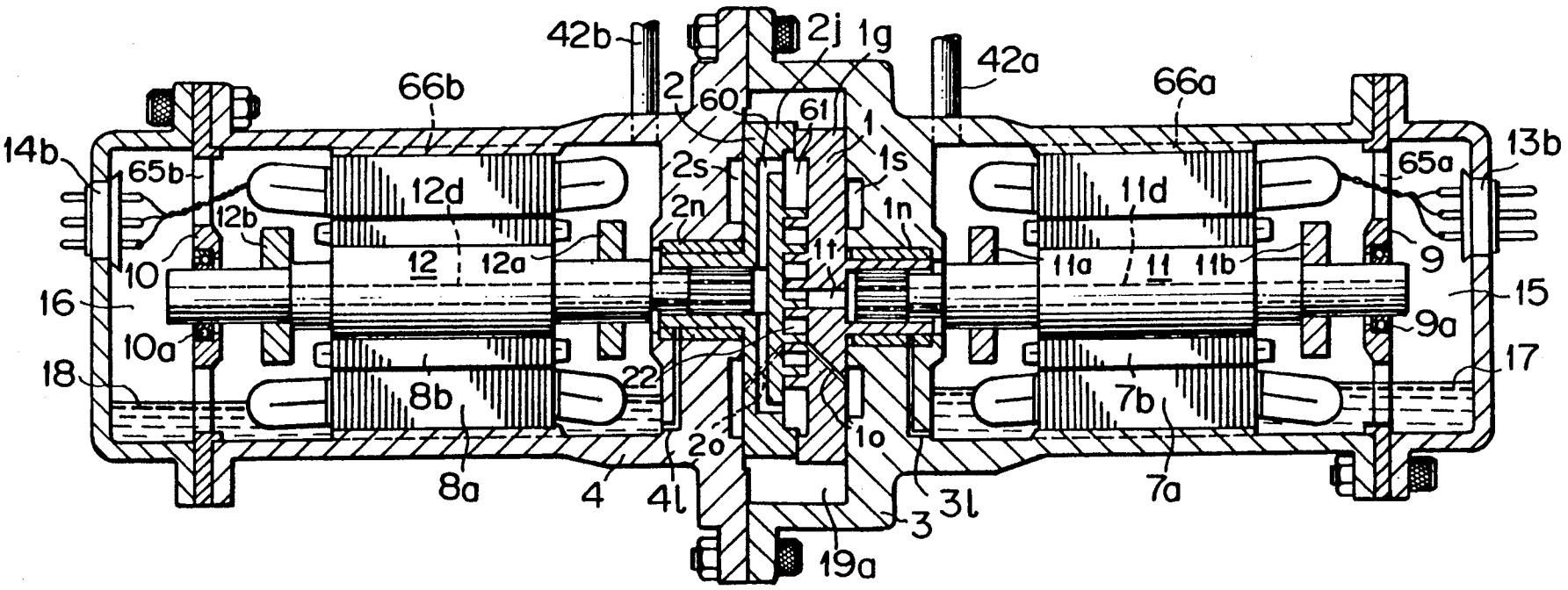
FIG. 2 is a longitudinal cross-sectional view of a second embodiment of a synchronous rotating type scroll fluid machine according to the present invention.

FIG. 2 shows a second embodiment of the synchronous rotating type scroll compressor according to the present invention. In this embodiment, the discharge port 1*t* is provided at the central portion of the end plate of the first scroll member 1 in such a manner that it communicates with the through-hole 11*d* formed in the first motor shaft 11, as shown in FIG. 2. No discharge port is formed within the second scroll member 2, and a flow passage 60 for the working fluid is provided in an radial fashion in the end plate thereof in such a manner that the central portion thereof communicates with the through-hole 12*d* provided in the second motor shaft 12. The other open ends of the flow passage 60 provided in the end plate of the second scroll member 2 communicate with a suction chamber 61 formed by the scroll wraps and the second thrust bearings 1*g*, 2*g* provided on the outer peripheral portions of the scroll end plates of the first and second scroll members 1 and 2. Also, the hermetic casings 3 and 4 are respectively provided with pipes 42*a* and 42*b* which communicate with outside of the compressor. The pipe 42*b* is a suction pipe, and the inner space of the second hermetic casing 4 is under a suction pressure. The pipe 42*a* is a discharge pipe, and the inner space of the first hermetic casing 3 is under a discharge pressure. The first and second scroll members 1 and 2 are supported by thrust bearings of the type which bear the members by utilizing the pressure of the gas in annular back pressure spaces 1*s* and 2*s* provided in the back surfaces of the first and second scroll members 1 and 2. The gas in the back pressure spaces 1*s* and 2*s* is supplied from the compression chamber.

The function of the synchronous rotating type scroll member compressor of the type shown in FIG. 2 will be described below. In this scroll member compressor, the space 16 in the second hermetic casing 4 constitutes the suction pressure space. The gas sucked from the suction pipe 42*b* passes through an opening 65*b* in a bearing support plate 10, the through-hole 12*d* in the second motor shaft 12, then through the radial flow passage 60 provided in the scroll end plate of the second scroll member 2 and enters the suction chamber 61. The gas in the suction chamber 61 is sucked into the compression working chamber 22 where it is compressed to a predetermined pressure. The resulting high-pressure gas discharged from the discharge port 1*t* passes through the through-hole 11*d* in the first motor shaft 11 and is then discharged into a space 15 in the first hermetic casing 3. The gas in the space 15 passes through the opening 65*a* in the bearing support plate 9 then through the plurality of flow passages 66*a* provided in the outer peripheral portion of the first motor and is discharged outside of the compressor from the discharge pipe 42*a*. Thus, in the second embodiment, the through-hole 12*d* in the second motor shaft 12 serves as the suction flow passage, while the through-hole 11*d* in the first motor shaft 11 serves as discharge flow passage. Consequently, the second motor (8*a*, 8*b*), the second motor shaft 12 and the second scroll member members 2, which are disposed within the second hermetic casing 4, are appropriately cooled by the suction gas. The members disposed within the first hermetic casing 3 are cooled by the high-pressure discharge gas to a degree which causes no problem in a practical operation, as in the case of the aforementioned first embodiment. Furthermore, since the gas being compressed in the compression chamber is introduced into the annular back pressure chambers 1*s* and 2*s* through communication holes 1*o* and 2*o* formed in the end plates of the two scroll members 1 and 2, the first and second scrolls 1 and 2 can be subjected to the gas pressure with which they can cope with the gas force in the compression chamber. Furthermore, since a space 19*d* is formed outside of the two rotary scroll members 1 and 2 in an annular form, the pressure in the space 19 balances due to the gas leaking from the annular spaces (back pressure chambers) 1*s* and 2*s*. Thus, provision of the sealing means at the back surfaces of the scroll end plates is elimination.

The structure and function of the second embodiment will now be described in further detail. The following description will be focused on the difference between the first and second embodiments. The hermetic casings 3 and 4 contain a motor, as in the case of the first embodiment. Both the first and second scroll members 1 and 2 have shaft portions which are in engagement with the main bearings 1*n* and 2*n* on the surfaces thereof which are remote from the scroll wraps. The one end portions of the motor shafts 11 and 12 are fitted into and are engaged with the shaft portions so that the rotary torques of the motors can be transmitted to the scroll chambers 1, 2. Although not shown, the rotary phase compensation means similar to that shown in FIGS. 5 and 6 are provided on the surfaces of the scroll members on which the scroll wraps are provided so as to allow the two motors to be rotated in the same direction and thereby allow the first and second scrolls 1 and 2 to be synchronously rotated. The outer peripheral portions of the scroll members 1 and 2 respectively constitute the second thrust bearing 1*g* and 2*g*, which are slidable against each other. The space 19 formed outside the rotary scroll members 1 and 2 is separated from the suction chamber 61 formed inside the scroll members by the second thrust bearing 1*g* and 2*g*. The second scroll member 2 has the radial flow passage 60 in the scroll end plate thereof, which communicates with the through-hole 12*d* provided in the second motor shaft 12 at the central portion of the second scroll member 2. The other end of the flow passage 60 communicates with the suction chamber 61 formed inside the first and second scroll members 1 and 2. The first scroll member 1 has in its central portion the discharge hole 1*t*. The first scroll member 1 is disposed such that the discharge hole 1*t* communicates with the through-hole 11*d* provided within the first motor shaft 11. The two rotary scroll members 1 and 2 respectively have on the back surfaces thereof annular back pressure spaces 1*s* and 2*s*, which communicate with the compression working chamber 22 via the plurality of communication holes 1*o* and 2*o* provided in the end plates of both the scroll members 1 and 2.

The operation of the embodiment shown in FIG. 2 will now be described. When power is supplied from an external power source to the motors through the hermetic terminals 13*b* and 14*b*, the motor shafts 11 and 12 rotate in the same direction, by which the first and second scroll members 1 and 2 rotate synchronously with the rotation of the motor shafts 11 and 12. Thus, the working gas enters the space 16 in the second hermetic casing 4 from the suction pipe 42*b*, and then reaches the back surface portion of the second scroll member 2 through the through-hole 12*d* in the second motor shaft 12. Thereafter, the gas enters the suction 61 from the radial flow passage 60 in the scroll end plate of the second scroll member 2 and then enters the compression working chamber 22. Since the compression working chamber 22 moves toward the central portion of the scrolls while reducing its volume as the scroll members 1 and 2 are rotated, the working gas is compressed and is discharged from the discharge hole 1*t* to the through-hole 11*d* in the first motor shaft 11. The high-pressure gas fills the space 15 in the first hermetic casing 3 and is then discharged outside of the compressor through the discharge pipe 42*a*. The back pressure chambers 1*s* and 2*s* formed in an annular form in the back surfaces of the first and second scroll members 1 and 2 are filled with the gas in the compression working chamber 22 by means of the communication holes 1*o* and 2*o*. The gas leaking from the annular back pressure chambers 1*s* and 2*s* fills the space 19 located outside thereof, equalizing the pressure level between the back pressure chambers 1*s* and 2*s* and the space 19*a*. Consequently, gas leakage is eliminated and the pressure level becomes stable. Also, provision of the sealing members on the back surfaces of the first and second scroll members 1 and 2 is eliminated, and the structure of the compressor is thereby simplified. The gas pressure in the back pressure chambers 1*s* and 2*s* is between the suction pressure and the discharge pressure, and is capable of generating the force which competes with the thrust load acting in the compression working chamber 22. Thus, the back surfaces of the rotary scroll members are prevented from being brought into contact with the casings 3 and 4, and smooth rotary motion can thus be achieved. Furthermore, in the second embodiment, since the interior of the second hermetic casing 4 forms the suction gas space, the members disposed within the second hermetic casing 4 are appropriately cooled by the gas. Particularly, since the suction gas flows along the back surface of the second scroll member 2, not only the second motor but also the main bearing 2*n* of the scroll member, which would be very difficult to be cooled in a conventional structure, can be cooled effectively.

Figure 3:
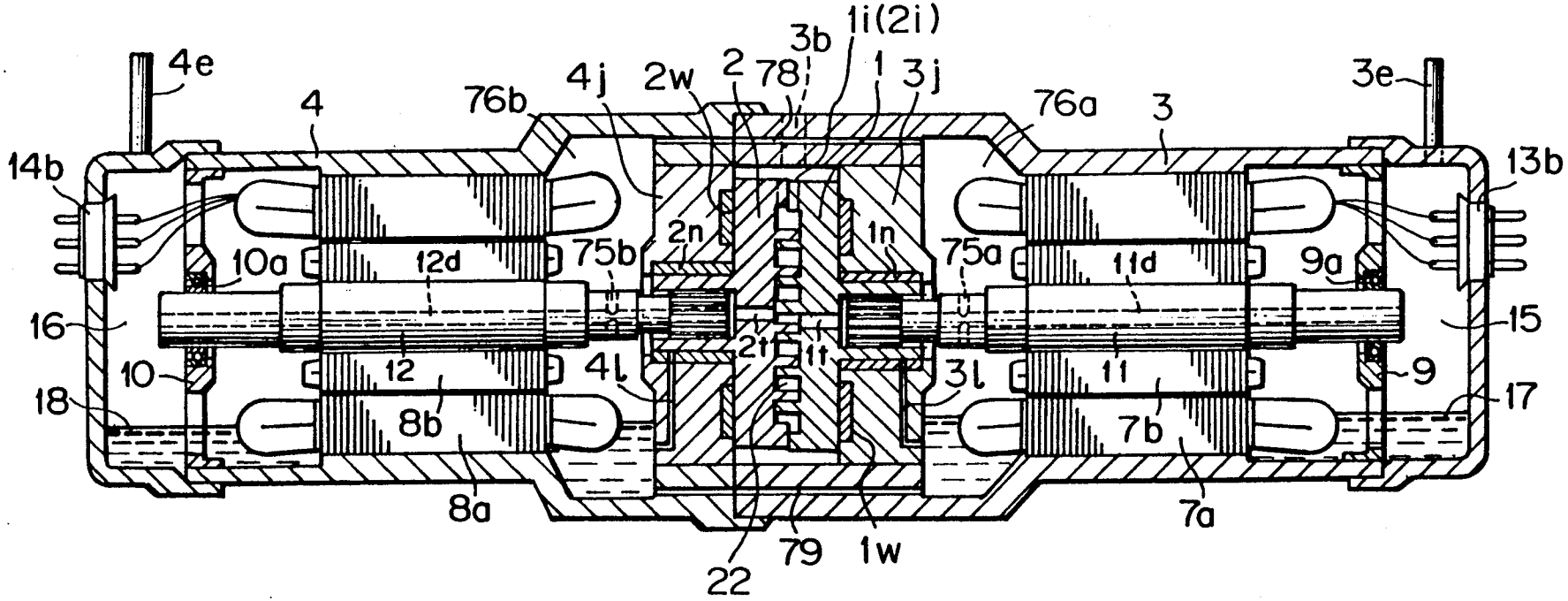
FIG. 3 a longitudinal cross-sectional view of a third embodiment of a synchronous rotating type scroll fluid machine according to the present invention.

FIG. 3 shows a third embodiment of the synchronous rotating type scroll member compressor according to the present invention. The basic structure of this third embodiment is similar to that of the first embodiment. As shown in FIG. 3, in order to balance the pressure in the first hermetic casing and the pressure in the second hermetic casing 4, communication holes (pressure-equalizing holes) 78 are provided between the hermetic casings 3 and 4 and frames 3*j* and 4*j* for making a space 76*a* in the first hermetic casing 3 connected to a space 76*b* in the second hermetic casing 4. Furthermore, lubricant-equalizing holes 79 are provided on the outer peripheral portions of the frames 3*j*, 4*j* for balancing the oil level between the two casings. Since the pressure in the first hermetic casing 3 is made equal to that in the second hermetic casing 4 by means of the pressure-equalizing holes 78, the thrust forces exerted to the first and second scroll members 1 and 2 by the high-pressure gas are made equal to each other.

The third embodiment will be described below in further detail with reference to FIG. 3 which is a view similar to FIG. 1. In the following description, the difference between the first and third embodiments will be focused. The frames 3*j* and 4*j* are fixed at the center of the hermetic casings 3 and 4, respectively, and the first and second scroll members 1 and 2 are rotatably disposed between these two frames 3*j*, 4*j*. The plurality of pressure-equalizing holes 78 for communicating the discharge spaces 76*a* and 76*b* in the hermetic casings with each other and the plurality of lubricant-equalizing holes 79 for balancing the level of lubricating oils 17 and 18 are provided on the outer peripheral portions of the frames 3*j* and 4*j*. The motor shafts 11 and 12 are rotatably supported by the bearings 1*n* and 2*n* provided at the central portions of the frames 3*j* and 4*j* and the bearings 1*n* and 2*n* fixed to the bearing supporting plates 9 and 10, respectively. The through-holes 11*d* and 12*d* are respectively formed in the motor shafts 11 and 12. Also, flow passages 75*a* and 75*b* are respectively formed in the intermediate portions of the motor shafts 11 and 12 in the radial direction in such a manner that they cross the through-holes 11*d* and 12*d*. The flow passages 75*a* and 75*b* respectively open to the discharge spaces 76*a* and 76*b* located between the motors 7, 8 and the frames 3*j* and 4*j*. As well as ones shown in FIGS. 1 and 2, flow passages extend in the axial direction between the motor stators 7*a* and 8*a* and the hermetic casings 3 and 4. The discharge pipes 3*e* and 4*e* respectively open to the spaces 15 and 16 located on the end surface sides of the motor shafts. The suction port 3*b* which communicates with the space between the frames 3*j* and 4*j* is formed through the casing 3 and the frame.

The operation of the third embodiment will now be described. When the first and second scroll members 1 and 2 are rotated in an engaged state, the refrigerant gas flows into the compression working chamber 22 from the suction port 3*b* through a suction flow passage 1*i*, 2*i*. The gas compressed in the compression chamber is discharged from the discharge holes 1*t* and 2*t* into the spaces 15 and 16 in the hermetic casings 3 and 4 through the through-holes 11*d* and 12*d* in the motor shafts 11 and 12. At that time, the gas is discharged into the discharge spaces 76*a* and 76*b* from the radial flow passages 75*a* and 75*b* which cross the through-holes 11*d* and 12*d* as well. However, since the fluid in the flow passages 75*a* and 75*b* is subjected to the centrifugal force resulting from the rotation of the motor shafts, the lubricating oil mixed in the suction gas is effectively separated from the gas in the flow passages 75*a* and 75*b*, thus allowing the discharge gas containing a lubricating oil to be charged into the discharge spaces 76*a* and 76*b*. The lubricating oil is further separated from the gas in the spaces 76*a* and 76*b* and the resulting gas passes through the gaps between the stators and rotors of the motors and the communication grooves provided on the outer peripheral portions of the stators and then reaches the spaces 15 and 16. In the spaces 15 and 16, the gas is combined with the discharge gases which have come straight through the through-holes 11*d* and 12*d*, and the combined gases are discharged outside the compressor from the discharge pipes 3*e* and 4*e*. During this discharge, the motors are effectively cooled by the high-pressure refrigerant gas from the inner sides of the shafts as well as the surfaces thereof. Furthermore, since the pressure-equalizing holes 78 are provided so as to make the gas pressures in the spaces in the hermetic casings 3 and 4 equal to each other, the thrust forces of the gases which act on the first and second scrolls 1 and 2 through the motor shafts 11 and 12 are substantially equal to each other. Thus, the gas forces exerted to the first and second scrolls 1 and 2 are balanced, and a very smooth high-speed operation can be achieved. Furthermore, since the oil level-equalizing pipes 79 are provided in such a manner that they communicate with the lubricating oil, the levels of the lubricating oils 17 and 18 are always equal to each other. Consequently, the lubricant oil can be supplied to the bearing surfaces from oil supply ports 3 and 4 under the same conditions. In this embodiment, the through-holes 11*d* and 12*d* are formed all through the motor shafts 11 and 12. However, they may be formed part of the motor shafts 11 and 12 unless the cooling effect is not degraded.

Thus, in the present invention, since the through-holes 11*d*, 12*d* are provided in the pair of motor shafts 11, 12 for rotating the pair of scroll members 1, 2 so as to allow the working fluid to flow therethrough, the motor cooling ability can be automatically changed according to the loads of the motors, and the motors can thus be operated at an adequate temperature over a wide operation range from the low-speed rotation to the high-speed rotation. Furthermore, since the refrigerant gas flows through the motor shafts 11, 12, cooling of the main bearings or the members located near the main bearings, which cannot be conventionally achieved, can be appropriately done. Furthermore, since the same amount of thrust force is exerted to the two motor shafts and two scrolls, pressing of the pair of scroll members 1, 2 in one direction can be eliminated. Consequently, contact between the forward portion of the scroll member wrap and the bottom surface thereof can be eliminated, and mechanical loss caused by friction at the high-speed rotation can be reduced, thus allowing the high performance to be maintained in the high-speed operation. Furthermore, the synchronous rotating type compressor according to the present invention has a simple structure and is small in size and weight. Furthermore, since the spaces within the hermetic casings can be effectively utilized as the gas and oil separating spaces, the oil gas separation efficiency can be enhanced, and the amount of oil which leaks due to the flow of the discharge gas can thus become at a minimum. Furthermore, the two scrolls employ the straight motor shafts so as to achieve synchronous rotation, and both of the rotary members have the center of gravity on the rotary axes thereof, and perform rotary motion around these axes. That is, a conventionally used eccentric member, such as a crank shaft, is not used, and imbalance does not thus occur due to rotation. Thus, low vibrations and high-speed rotation can be achieved. Furthermore, since the balance weight, which would be used conventionally in combination with the crank shaft, is not necessary for the motor shafts 11, 12, the bearing is not subjected to the resulting centrifugal force, and the load acting on the bearing or sliding portion can thus be reduced. Also, the means for preventing the revolution of a orbiting scroll member, which is conventionally required, can be eliminated. Thus, the load can be reduced while the number of parts is reduced, and the performance of the compressor can thus be enhanced.

Figure 4:
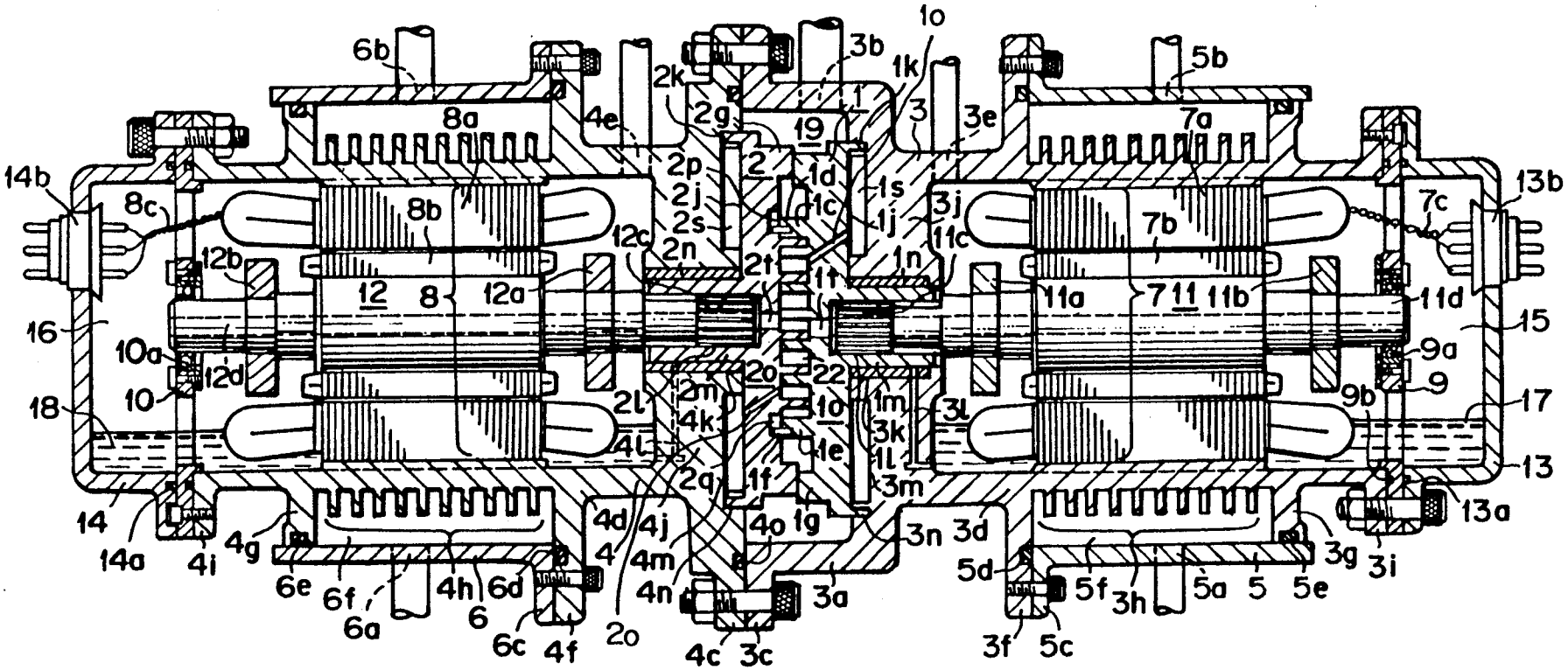
FIG. 4 is a longitudinal cross-sectional view of a fourth embodiment of a synchronous rotating type scroll fluid machine according to the present invention.

A fourth embodiment of the present invention will be described with reference to FIGS. 4 through 6. FIG. 4 is a longitudinal cross-sectional view of a hermetic compressor which is one example of a synchronous rotating type scroll member fluid machine. FIGS. 5 and 6 are respectively perspective views of first and second scroll members 1 and 2.

In a first scroll member 1, a spiral scroll member wrap 1*b* is provided erect on a disk-shaped scroll member end plate 1*a*. On the scroll member end plate 1*a*, a pin base 1*c* with a pin 1*d* fixed thereto and a pin base 1*e* with a pin 1*f* fixed thereto are provided on the outer side of the scroll member wrap 1*b*, and an annular second thrust bearing 1*g* is provided on the outer side of the pin 1*d* and 1*f* and pin bases 1*c* and 1*e* as if it surrounds them. The second thrust bearing 1*g* has gas flow passage grooves 1*h* and 1*i* at positions which are substantially symmetrical relative to the center of the first scroll member. The thrust bearing 1*g* also has at one portion thereof a recess 1*r* for providing balance between the thrust bearing and the scroll wrap. This recess 1*r* ensures that the center of the gravity of the first scroll member is at the center of rotation thereof.

As shown in FIG. 4, the scroll end plate 1*a* of the first scroll member 1 has a connecting hole 1*o* for connecting the compression working chamber 22 and a back pressure space 1*s* provided on a rear 1*j* of the scroll end plate. In this embodiment, a pair of connecting holes 1*o* is provided in one scroll member. However, a plurality of connecting holes 1*o* may be formed at positions which are substantially symmetrical with respect to the center of the scroll member 1. The back pressure space 1*s* is substantially hermetically sealed by the thrust surface 1*j* provided on the rear surface of the end plate 1*a* and a recess 3*m* of a frame portion 3*j* formed integrally with the casing 3. During the operation of the compressor, gas having a pressure level between the discharge pressure and the suction pressure flows into this space 1*s* from the compression chamber through the connecting hole 1*o*, and thereby maintains the inner pressure in the back pressure space 1*s* to an intermediate pressure, by which the thrust force of the first scroll member 1 which acts on the first thrust bearing can be reduced.

The scroll end plate 1*a* has at a central portion thereof a discharge port 1*t* which passes through the scroll end plate 1*a*. At the outer peripheral portion of the rear surface of the end plate 1*a*, an annular projecting portion 1*k* projects from the surface of the scroll end plate 1*a*. The projecting portion 1*k* is fitted into an annular groove 3*n* of the frame portion 3*j* formed integrally with the casing 3 with an adequate gap therebetween. The projecting portion 1*k* and the annular groove 3*n* in combination serve as the slide bearing during the operation of the compressor. The scroll end plate 1*a* has, at the central portion and on the rear surface thereof which is opposite to the scroll member wrap 1*b*, a cylindrical portion on which a shaft coupling portion 1*l* is formed. The shaft coupling portion 1*l* consists of a female spline shaft coupling 1*m* formed on the inner peripheral surface of the cylindrical portion, and a journal bearing opposing surface 1*n* formed on the outer peripheral surface thereof.

The second scroll member 2 has a similar structure to the first scroll member 1. That is, a spiral scroll member wrap 2*b* is provided erect on a disk-shaped scroll member end plate 2*a*. On the end plate 2*a*, pin holes 2*p* and 2*q*, which respectively receive the pins 1*d* and 1*f* formed on the first scroll member 1 with a gap therebetween, are provided on the outer side of the scroll member wrap 2*b*, and an annular second thrust bearing 2*g* projects from the surface of the end plate 2*a* on the outer side of the pin holes 2*p* and 2*q*, as if it surrounds them. The second thrust bearing 2*g* has gas flow passage grooves 2*h* and 2*i* at positions which are substantially symmetrical with respect to the center of the second scroll member. The second thrust bearing 2*g* also has a recess 2*r* for providing balance between the scroll wrap and the annular second thrust bearing 2*g*. The recess 2*r* ensures that the center of gravity of the second scroll member 2 is at the center of its rotation.

The scroll end plate 2*a* has a connecting hole 2*o* for connecting the compression working chamber 22 and a back pressure space 2*s* provided on a rear 2*j* of the scroll end plate. In this embodiment, the single connecting hole 2*o* is provided in one scroll member. However, a plurality of connecting holes 2*o* may be formed at positions which are substantially symmetrical with respect to the center of the scroll member. The back pressure space 2*s* is substantially hermetically sealed by the thrust surface 2*j* provided on the rear surface of the end plate 2*a* and a recess 4*m* of a frame portion 4*j* formed integrally with the casing 4. During the operation of the compressor, gas having a pressure level between the discharge pressure and the suction pressure flows into this space 2*s* from the compression working chamber 22 through the connecting hole 2*o*, and thereby maintains the inner pressure in the back pressure space 2*s* to an intermediate pressure, by which the thrust force of the second scroll member which acts on the first thrust bearing can be reduced.

The scroll end plate 2*a* has at a central portion thereof a discharge port 2*t* which passes through the scroll end plate 2*a*. At the outer peripheral portion of the rear surface of the scroll end plate 2*a*, an annular projecting portion 2*k* projects from the surface of the scroll end plate 2*a*. The projecting portion 2*k* is fitted into an annular groove 4*n* of the frame portion 4*j* formed integrally with the casing 4 with an adequate gap therebetween. The projecting portion 2*k* and the annular groove 4*n* in combination serve as the journal bearing during the operation of the compressor.

The scroll end plate 2*a* has, at the central portion and on the rear surface thereof which is opposite to the scroll member wrap 2*b*, a cylindrical portion on which a shaft coupling portion 2*l* is formed. The cylindrical portion is formed integrally with the scroll end plate 2*a*. The shaft coupling portion 2 consists of a female spline shaft coupling 2*m* formed on the inner peripheral surface of the cylindrical portion, and a journal bearing opposing surface 2*n* formed on the outer peripheral surface thereof. The first and second scroll members 1 and 2 are disposed between the frames 3*j* and 4*j* with the wrap portions thereof engaged with each other. In order to allow the scroll members 1 and 2 to be rotated at the same time, a suitable gap is provided between the rear surface 1*j* of the scroll end plate 1*a* and the frame 3*j* and between the rear surface 2*j* of the end plate 2*a* and the frame 4*j*, and a lubricating oil is supplied to these gaps. When the both scroll members 1 and 2 are rotated, the pins 1*d* and 1*f* are respectively fitted into the pin holes 2*p* and 2*q*, by which the relative positional relation between the two scroll members in the direction of rotation can be defined such that the scroll wraps 1*b* and 2*b* do not contact with each other. The gas flow passage grooves 1*i* and 2*h* and 1*h* and 2*i* are combined with each other to form large suction flow passages. The gas flows into the compression working chamber 22 from a suction pressure space 19 provided on the outer peripheral portions of the scroll members through these gas flow passages.

The casing 3 has a scroll member chamber forming portion 3*a* on the left side of the frame portion 3*j*, and a motor chamber forming portion 3*d* on the right side of the frame portion 3*j*. The scroll member chamber forming portion 3*a* has a suction inlet 3*b* which is opened in the circumferential direction, and a cylindrical flange 3*c* on the end surface side thereof. The motor chamber forming portion 3*d* has a discharge pipes 3*e* on the circumferential side, and flanges 3*f*, 3*g* and 3*i*. Between the flanges 3*f* and 3*g* is provided a hermetic space 5*f*. The hermetic space 5*f* includes a plurality of fins 3*h* and a cylindrical member 5 having an inlet 5*a* and an outlet 5*b* for a cooling liquid and provided on the outer peripheral portions of the fins 3*h*. In the hermetic space 5*f*, sealing members 5*d* and 5*e* are provided opposite to the cylindrical member 5. The cylindrical member 5 is hermetically sealed by tightening the flange 3*f* and a flange 5*c* by means of bolts or the like.

Inside the motor chamber forming portion 3*d*, a first motor 7, consisting of a motor stator 7*a* and a motor rotor 7*b*, is disposed. The motor stator 7*a* is fixed to the motor chamber forming portion 3*d*, and the motor rotor 7*b* is fixed to a rotary shaft 11. One end of the first motor shaft 11 is supported by a bearing 9*a* fixed to a bearing support plate 9. The other end of the motor shaft 11 has a male spline shaft coupling 11*c*, which is in engagement with the female spline shaft coupling 1*m* formed on the first scroll member 1. Balance rings are fixed to the motor shaft 11. The motor shaft 11 has a through-hole 11*d* formed therein. One end of the through-hole 11*d* faces the discharge port 1*t*, and the other end thereof opens to a space 15. A side casing 13 has a hermetic terminal 13*b*. The side casing 13 has at an end portion thereof a flange, which is fixed to the flange 3*i* with the bearing support plate 9 therebetween to form a space 15 in which a lubricating oil 17 is accommodated. The motor stator 7*a* and the hermetic terminal 13*b* are electrically connected to each other via an electric wire 7*c* provided in the space 15. One end of a lubricating oil supply hole 3*l* formed in the frame portion 3*j* opens into the lubricating oil 17, and the other end thereof opens to the inside the slide bearing 1*n*.

The casing 4 has a structure similar to the casing 3. The casing 4 does not have a portion corresponding to the scroll member chamber forming portion 3*a* provided in the casing 3 but has, on the outer peripheral portion of the frame portion 4*j*, a flange portion 4*c* which is coupled to the flange 3*c* provided in the casing 3. Inside the motor chamber forming portion 4*d*, a motor 8 is disposed, and a pair of balance rings 12*a* and 12*b* are fixed to a second motor shaft 12 at the two ends of the motor rotor 8*b*. A bearing 10*a* is fixed to a bearing support plate 10 provided at the end surface of the motor chamber forming portion 4*d*, and the motor shaft 12, having a through-hole 12*d* therein, is rotatably supported by this bearing 10*a* and the cylindrical portion 2*l* of the second scroll member 2.

At the end surface of the motor chamber forming portion 4*d*, a flange portion 14*a* of a side casing 14 is fixed to a flange 4*a* and 4*i*, by which a space 16 is provided. On the outer peripheral portion of the motor chamber forming portion 4*d* is formed a hermetic space 6*f*. A working gas discharge port 4*e* is provided parallel to the hermetic space 6*f*. The discharge pipes 4*e* is connected to an external pipe. One end of a lubricating oil supply hole 4 opens into a lubricating oil 18, and the other end thereof opens to the inside the bearing 2*n*.

The operation of the synchronous rotary scroll member type fluid machine will now be described in detail. When power is supplied to the motors 7 and 8 through the hermetic terminal 13*b* at the same time, the motor rotors 7*b* and 8*b* rotate, by which the first and second scroll members 1 and 2 coupled to the motors are rotated. At that time, the pin 1*d* formed on the surface of the scroll end plate 1*a* of the first scroll member 1 is fitted into the pin hole 2*p* provided in the second scroll member 2, while the pin 1*f* is fitted into the corresponding pin 2*q*, by which the rotary phase compensation means is formed. The rotary phase compensation means rotate the two scroll members in the same direction at the same rotational speed. In this embodiment, only one pair of pin and pin hole is provided. However, a plurality of pairs of pins and pin holes may be provided to form the rotary phase compensation means. As the two scroll members are rotated, gas is sucked into the suction pressure space 19 through the suction port 3b from outside of the compressor, and then enters the compression working chamber 22 formed by the first and second scroll members through the gas flow passage grooves 1h, 1i, 2h and 2i. The compression working chamber 22 moves toward the center of the rotation while decreasing the volume thereof when the scrolls are rotated. Therefore, the gas in the compression working chamber 22 is compressed and led to the discharge ports 1t and 2t. Thereafter, the discharge gas directed to the motor shafts 11 and 12 passes through the through-holes 11d and 12d while indirectly cooling the rotors 7b and 8b and then flows into the discharge spaces 15 and 16. The discharge gas which has flown into the discharge space 15 passes through a gap between the rotor 7b and the stator 7a and outside the stator 7a while cooling the motor 7, and is then discharge outside the compressor from the discharge pipes 3e. Similarly, the discharge gas which has flown into the discharge space 16 passes through a gap between the rotor 8b and the stator 8a and outside the stator 8a while cooling the motor 8, and is then discharged outside the compressor from the discharge pipes 4e.

The projecting portions 1k and 2k on the rear surfaces of the scroll end plates are fitted into the annular grooves 3n and 4n in the frame portions 3j and 4j with an appropriate gap therebetween, and a lubricating oil is supplied into the gaps. Therefore, the gas sealing effect is obtained, and the gas which maintains the pressure in the back pressure spaces 1s and 2s is thus not substantially mixed with the gas in the suction space 19. The area of the back pressure spaces 1s and 2s is determined according to the inner pressure so that a thrust force can be generated to a degree at which it is capable of restricting a displacement of the first and second scroll members in the direction in which they are separated from each other. The centrifugal force generated on the side of the scroll member wrap by the rotation of the scroll member acts on the end plate in the form of a moment load, as mentioned above, and displaces the end plate in such a manner that the scroll member wrap side thereof is protruded. The centrifugal force of the projecting portions 1k and 2k on the rear surfaces of the scroll end plates acts as a counter moment of the aforementioned moment, and reduces the deformation of the scroll end plate.

When the inner pressure in the back pressure spaces 1s and 2s increases, a thrust force acts such that the distance between the end plates 1a and 2a reduces. At that time, the deformation of the scroll end scroll plates 1a and 2a in a direction in which they move closer each other is restricted by slide of the forward portion of the second thrust bearing 1g provided on the surface of the scroll end plate against the forward portion of the second thrust bearing 2g. In addition to the gas in the compression working chamber 22, lubricating oils 17 and 18 respectively flow into the back pressure spaces 1s and 2s through the oil supply holes 3l and 4l via the bearings 3k and 4k. The lubricating oils 17 and 18 further flow into the suction pressure space 19 due to a pressure difference, and are mixed with the suction gas. Thereafter, the lubricating oils 17 and 18 enter the compression working chamber 22 together with the suction gas, lubricate the scroll member wraps 1b and 2b and then return to the casings 3 and 4 through the through-holes 11d and 12d together with the discharge gas, returning to the spaces 15 and 16. In this state, the lubricating oil and the discharge gas are present in a mixed state. However, the gas flow rate is low in the discharge chambers 15 and 16, and the lubricating oil and the gas are separated from each other and the lubricating oil can thus be retrieved within the casings.

The motors 7 and 8 and the lubricating oils 17 and 18 can be cooled by circulating the cooling water in the hermetic spaces 5f and 6f separated from the hermetic casings 3 and 4. When the temperature of the motors 7 and 8 is low, gas may be circulated in place of the cooling water.

In this embodiment, since the projecting portions 1k and 2k are provided on the rear surfaces of the end plates, the flexural stiffness of the end plates 1a and 2a is increased, allowing deformation of the scroll end plates due to an external force to be reduced. Furthermore, even if the projecting portions 1k and 2k may be deformed due to the centrifugal force, since the annular grooves 3n and 4n have the bearing function, movement of the projecting portions 1k and 2k closer to the grooves 3n and 4n increases the pressure of the fluid present in the gaps therebetween, and deformation of the end plates is further restricted forcibly. Consequently, the gap between the scroll member wraps can be maintained to an appropriate value, and the performance of the compressor can thus be enhanced. Furthermore, since both the scroll members 1 and 2 are coupled to the motor shafts 11 and 12 by means of the spline shaft coupling, the allowance of the error of the degree of eccentricity between the scrolls 1 and 2 can be increased, facilitating machining of the parts. Also, since the motor shafts 11 and 12 can be coupled to each other after the scroll member wraps 1b and 2b have been engaged with each other, assembly is facilitated.

Figure 7:
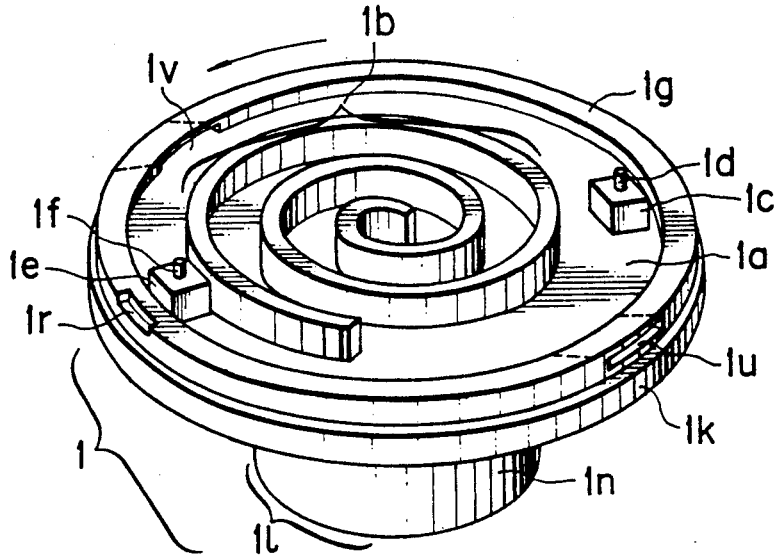
FIG. 7 is a perspective view of a first scroll member of a fifth embodiment according to the present invention.

A fifth embodiment of the synchronous rotating type scroll member fluid machine according to the present invention will be described below with reference to FIG. 7. FIG. 7 is a perspective view of the first scroll member of the fifth embodiment. An annular second thrust bearing 1g has in it gas flow passage holes 1u and 1v. That is, in this embodiment, the gas flow passage holes 1u and 1v are provided in place of the gas flow passage grooves 1h and 1i in the fourth embodiment. Furthermore, the second scroll member has two gas flow passage holes similar to the gas flow passage holes 1u and 1v so as to form the suction gas flow passage. The other structure and operation of this embodiment are substantially the same as those of the fourth embodiment.

According to the present embodiment, since the second thrust bearings 1g and 2g do not have the grooves which form the gas flow passages, unlike the fourth embodiment, the flexural stiffness of the scroll end plates 1a and 2a is increased, and the deformation of the end plates can thus be further reduced. As a result, the gap between the scroll member wraps can be further appropriately maintained.

Figure 8:
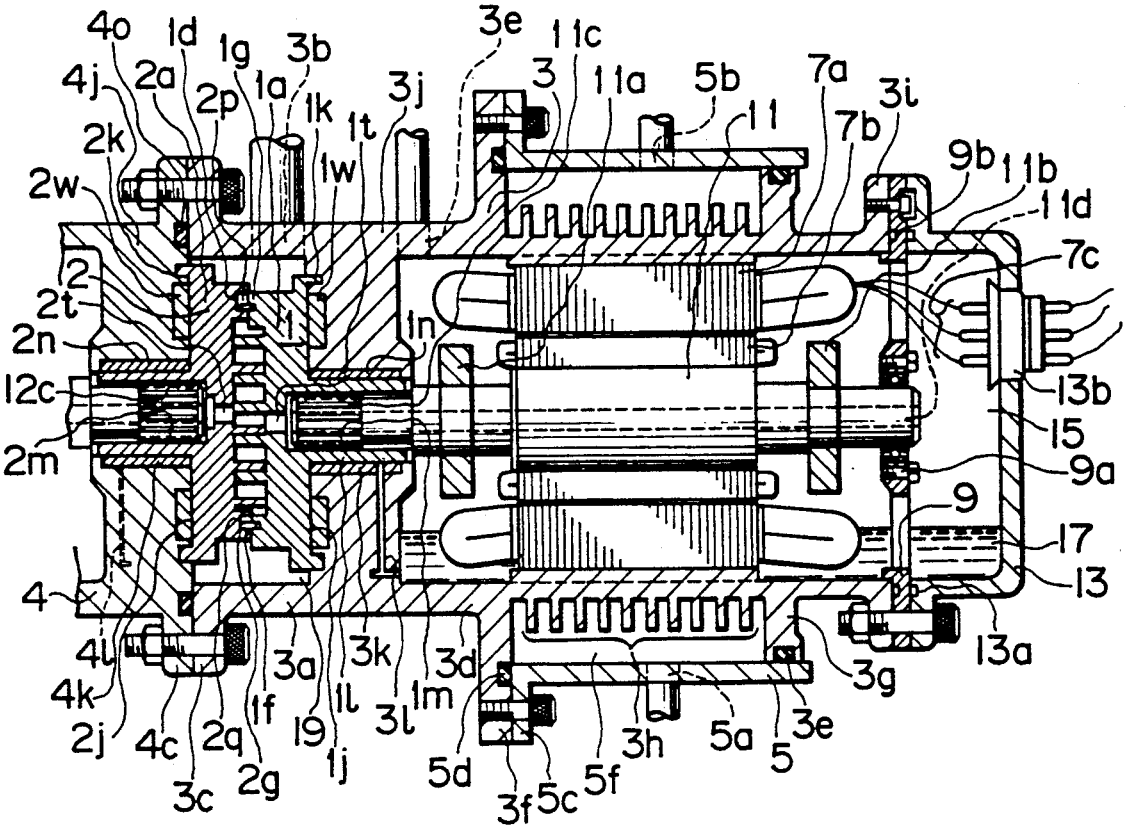
FIG. 8 is a cross-sectional view of a first scroll member of a fluid machine, showing a sixth embodiment of the present invention.
Figure 9:
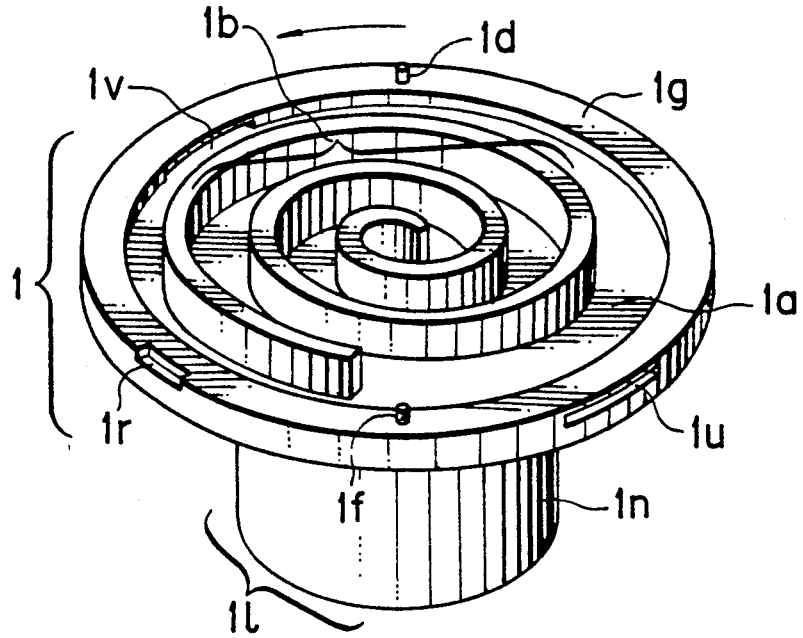
FIG. 9 is a perspective view of a first scroll member of the sixth embodiment according to the present invention.
Figure 10:
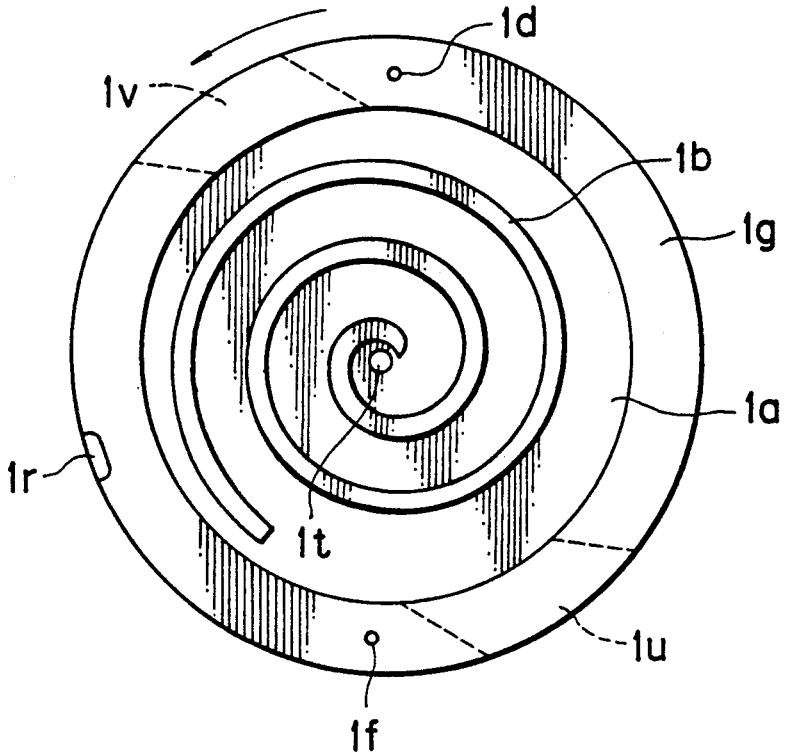
FIG. 10 is a plan view of the first scroll member of the sixth embodiment according to the present invention.

A sixth embodiment of the present invention will be described below with reference to FIGS. 8, 9 and 10. FIG. 8 is a longitudinal cross-sectional view of a first scroll member 1, showing the structure of the portion of this embodiment corresponding to the right half of the embodiment shown in FIG. 1, which is part of a hermetic type compressor as shown in FIG. 1. FIG. 9 is a perspective view of the first scroll member 1. FIG. 10 is a plan view of the first scroll member 1. In this embodiment, dynamic pressure thrust bearings 1*w* and 2*w* are used as the first thrust bearings in place of the back pressure spaces 1*s* and 2*s*. Both the dynamic pressure thrust bearings 1*w* and 2*w* are respectively provided in an annular form in opposed relation to the rear surfaces of the first and second scroll members 1 and 2.

The dynamic pressure thrust bearings 1*w* and 2*w* are respectively fitted into the frame portions 3*j* and 4*j* in a state wherein rotation thereof is inhibited. Furthermore, in this embodiment, the pins 1*d* and 1*f* are mounted on the second thrust bearing 1*g*, unlike the case of the fifth embodiment in which the pins 1*d* and 1*f* are mounted on the pin bases 1*c* and 1*e*. The pin holes 2*p* and 2*q* are formed in the second thrust bearing 2*g*. As a result, the outer diameter of the scroll members is reduced, and the diameter of the suction pressure space 19 can thus be reduced. In the dynamic pressure thrust bearing, liquid or gas is provided on a support surface thereof. The dynamic pressure thrust bearing is designed to bear a thrust load by the rotary motion of a member. In this embodiment, since the dynamic pressure thrust bearings are provided, the thrust support ability can be enhanced by the rotation of the scroll members 1, 2 and frictional loss can be maintained low, thus allowing a stable rotary motion to be achieved. Thus, since the parallel movement of the scroll members is restricted by the first thrust bearings 1*w*, 2*w* and the second thrust bearings 1*g*, 2*g* while deformation of the end plates 1*a* and 2*a* can be prevented by a centrifugal force of the annular projecting portions 1*k* and 2*k* provided on the outer peripheral portions of the rear surfaces of the scroll end plates 1*a* and 2*a*, a gap between the scroll member wraps can be maintained to an appropriate value during the operation of the compressor. The other structure and operation of this embodiment are substantially the same as those of the fifth embodiment, further description of this embodiment being omitted.

Figure 11:
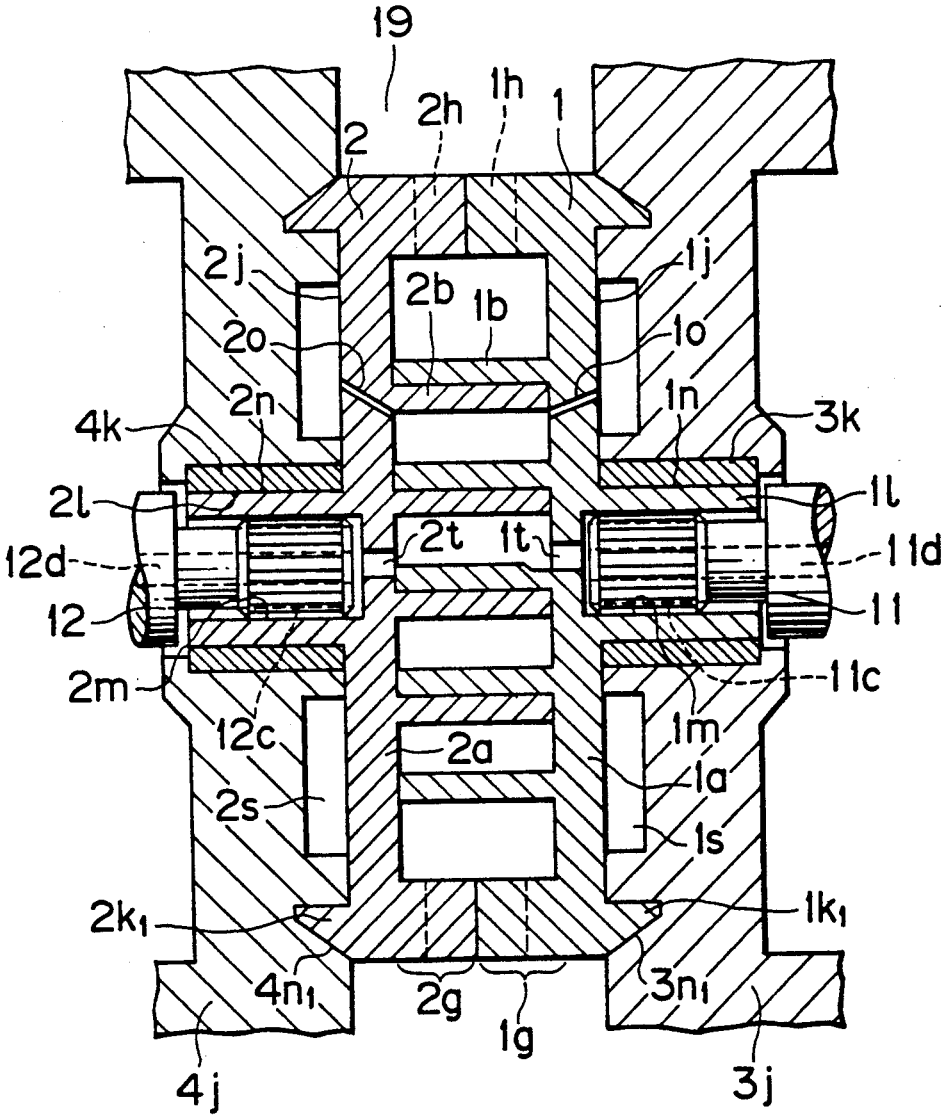
FIG. 11 is a cross-sectional view of a scroll member of a seventh embodiment according to the present invention.

A seventh embodiment of the present invention will be described with reference to FIG. 11. FIG. 11 is an enlarged view of an engaged portion of the scrolls, showing the structure of the portion of the seventh embodiment corresponding to the central portion of the embodiment shown in FIGS. 1–4. In this embodiment, annular projecting portions $1k_1$ and $2k_1$ are provided on the outer peripheral portions of the scroll end plates, and first thrust bearings 1*s*, 2*s* are disposed on the inner sides of the projection portions $1k_1$ and $2k_1$ at positions where the intermediate gas pressure are provided in the embodiment shown in FIG. 1. The other structure and function of this embodiment are substantially the same as those of the embodiment shown in FIG. 4, description thereof being omitted. The seven embodiment is characterized in the structure of the annular projecting portions $1k_1$ and $2k_1$ provided on the rear surfaces of the end plates. That is, the outer periphery of the projecting portion $1k_1$ is inclined, and such a projecting portion $1k_1$ is meshed with an annular groove $3n_1$ of the flame portion 3*j*, which is recessed to receive the tapered outer periphery of the projecting portion with an adequate gap therebetween. When the scroll member 1 is rotated in that state, the projecting portion $1k_1$ is deformed in an outward direction by a centrifugal force. The deforming force of the projecting portion $1k_1$ is received by the inclined surface of the groove $3n_1$. Therefore, the resulting reaction is divided into a component along the inclined surface and a component perpendicular to that component. As a result, the component force along the inclined surface works as the thrust force directed toward the scroll member wrap. Thus, in this embodiment, since deformation of the scroll end plate in an arc in which the scroll member wrap side thereof is protruded is further restricted by the component force generated on the inclined surface in the thrust direction, the gap between the scroll member wraps can be maintained small even when the rotational speed of the scroll members is increased, and a more stable rotary motion can thus be achieved.

Figure 12:
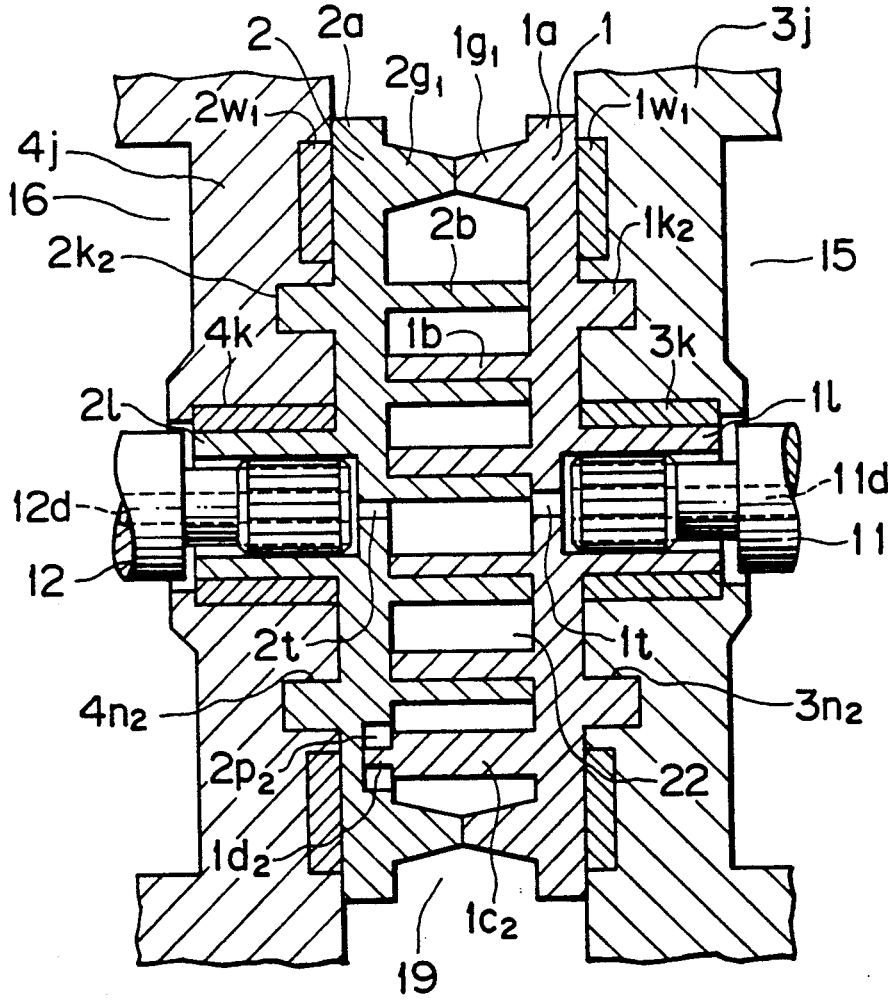
FIG. 12 is a cross-sectional view of a scroll member of an eighth embodiment according to the present invention.
Figure 13:
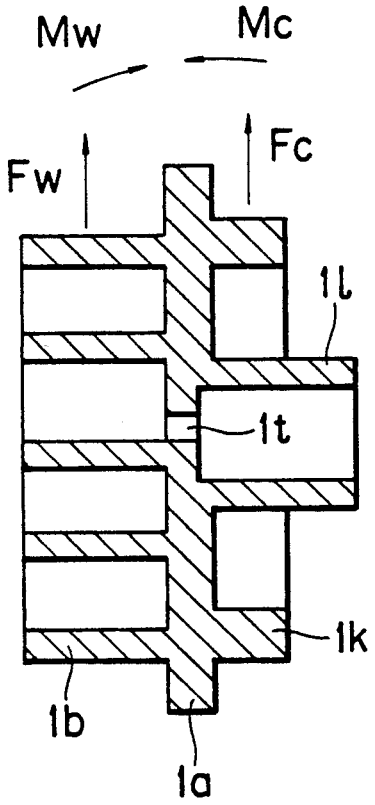
FIG. 13 is a cross-sectional view of the scroll member, illustrating the function of the eighth embodiment.

An eighth embodiment of the present invention will be described below with reference to FIG. 12. FIG. 12 is an enlarged view of an engaged portion of the scroll members, showing the structure of the portion of the eighth embodiment corresponding to the central portion of the embodiment shown in FIGS. 1–4. In this embodiment, annular projecting portions $1k_2$ and $2k_2$ on the rear surfaces of the scroll end plates are provided on an inner peripheral portion of the scroll end plates, and dynamic pressure type thrust bearings $1w_1$ and $2w_1$ are disposed as the first thrust bearings on the outer side of the annular projecting portions $1k_2$ and $2k_2$. Furthermore, second thrust bearings 1*g*1 and 2*g*1 are formed on the front surface of the scroll end plates in an annular form, by which the areas of the sliding surface thereof is reduced. Furthermore, a pin $1d_2$ and a pin hole $2p_2$, constituting the rotary phase compensation means of the two scroll members 1 and 2, are provided on the inner side of the second thrust bearings $1g_1$ and $2g_1$. Although the gas flow passages, which provide communication between the suction pressure space 19 and the outer peripheral portion of the scroll wraps 1*b* and 2*b*, are not shown in FIG. 12, they are formed at different cross-sectional positions in such a manner that they pass through the second thrust bearings $1g_1$ and $2g_1$ in the radial direction thereof. The dynamic pressure type thrust bearings $1w_1$ and $2w_1$ are designed to increase a thrust supporting force as the rotational speed increases. Therefore, these thrust bearings 1*w*, 2*w* are capable of generating excess force of deforming the scroll end plates 1*a* and 2*a* toward the wraps according to the rotational speed of the motor, as compared with the back pressure provision type thrust bearings 1*s* and 2*s* shown in the fourth embodiment which generate a substantially fixed amount of thrust force. Although the annular projecting portions 1*k*2 and 2*k*2 are formed of the same material as the scroll end plates 1*a* and 2*a*, annular projecting portions made of a material having a large specific gravity, such as lead, separately from the scroll end plates may be mounted on the scroll end plates. The annular projecting portions 1*k*1 and 2*k*2 made of a material having a large specific gravity assures substantially the same level of centrifugal force as that in the first embodiment even when the rotary radius is small. Consequently, the posture of the scroll members 1, 2 can be maintained in a normal state and the gap between the scroll wraps can thus be maintained appropriately. Furthermore, the rotational circumferential speed of the annular projecting portions 1*k*2 and 2*k*2 can be reduced, and frictional loss thereof caused by the slide thereof against the annular grooves 3*n*1 and 4*n*1 can thus be reduced. Furthermore, since the contact between the scroll wraps can by prevented by means of the rotational phase compensation means of the two scrolls, vibrations can noise level can be reduced at a high-speed rotation, and a high-performance synchronous rotating type scroll member compressor can thus be provided.

Figure 14:
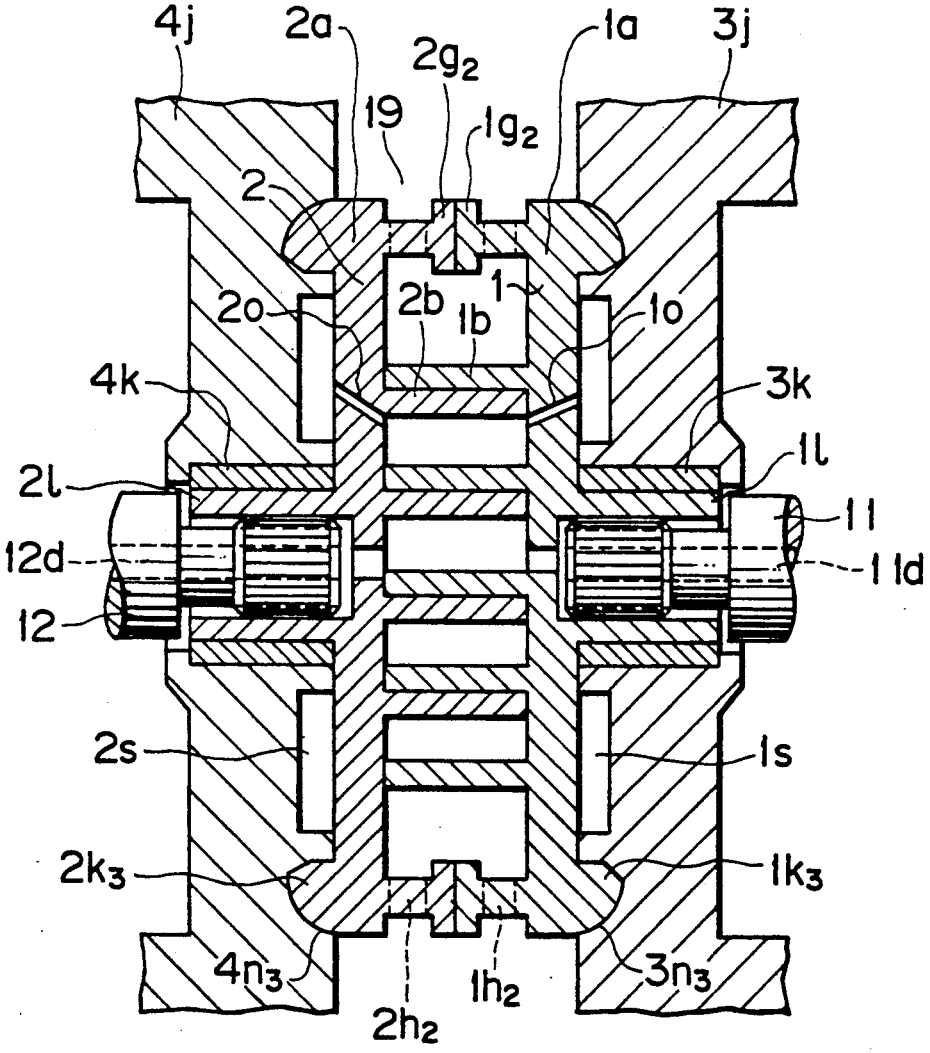
FIG. 14 is a cross-sectional view of a scroll member of a ninth embodiment according to the present invention.

A ninth embodiment of the present invention will be described below with reference to FIG. 14. FIG. 14 is an enlarged view of an engaged portion of the scroll members, showing the structure of the portion of the ninth embodiment corresponding to the central portion of the embodiment shown in FIGS. 1–4. In this embodiment, annular projecting portions 1k3 and 2k3 on the rear surfaces of the scroll end plates have an arcuate outer peripheral portion, and the inner peripheral portion of annular grooves 3n3 and 4n3 of the frame portions 3j and 4j, with which the annular projecting portions 1k3 and 2k3 are meshed, is recessed in a similar arcuate form. The meshed portion between the projecting portions and the grooves has an adequate gap. The gap thereof is relatively small at the arcuate portion, and is relatively large at the inner straight portion. The first thrust bearings 1s, 2s are of the back pressure type, as in the case of the seventh embodiment. The first thrust bearings 1s, 2s are provided on the inner side of the annular projecting portions 1k3 and 2k3. The second thrust bearings 1g2, 2g2 are made of a material which is light in weight. The second thrust bearings 1g2, 2g2 have a T-shaped cross-section, and are annular. A plurality of gas flow passages 1h2 and 2h2 for connecting the suction pressure space 19 to the outer peripheral portion of the scroll wraps 1b and 2b are formed in the circumferential direction in such a manner that they pass through the second thrust bearings 1g2 and 2g2 in the radial direction thereof.

Although not shown, a plurality of rotary phase compensation means for the two scroll members 1, 2 are provided on the circumference of the second thrust bearings 1g2 and 2g2, as in the case of the sixth embodiment. Even when the scroll end plates are slightly deformed in an arc by the rotation of the scroll members, since the annular projecting portions 1k3 and 2k3 are meshed with the arcuate annular grooves 3n3 and 4n3, they can escape along the arcuate form without making contact with the annular grooves. Furthermore, the size of the gap in the arcuate portion can remain substantially the same even when the end plates are slightly deformed in an arc. Thus, in this embodiment, the sealing effect of the meshed portion of the annular projecting portions 1k3 and 2k3 is particularly enhanced. Consequently, the pressure level in the back pressure spaces 1s and 2s can be maintained to an appropriate value, and an adequate thrust force can be exerted to the scroll members 1, 2, thus providing a compressor exhibiting an excellent performance. Furthermore, since the second thrust bearings 1g2 and 2g2 are light in weight, the centrifugral force thereof can be reduced, thus reducing deformation of the end plates 1a, 2a.

Figure 15:
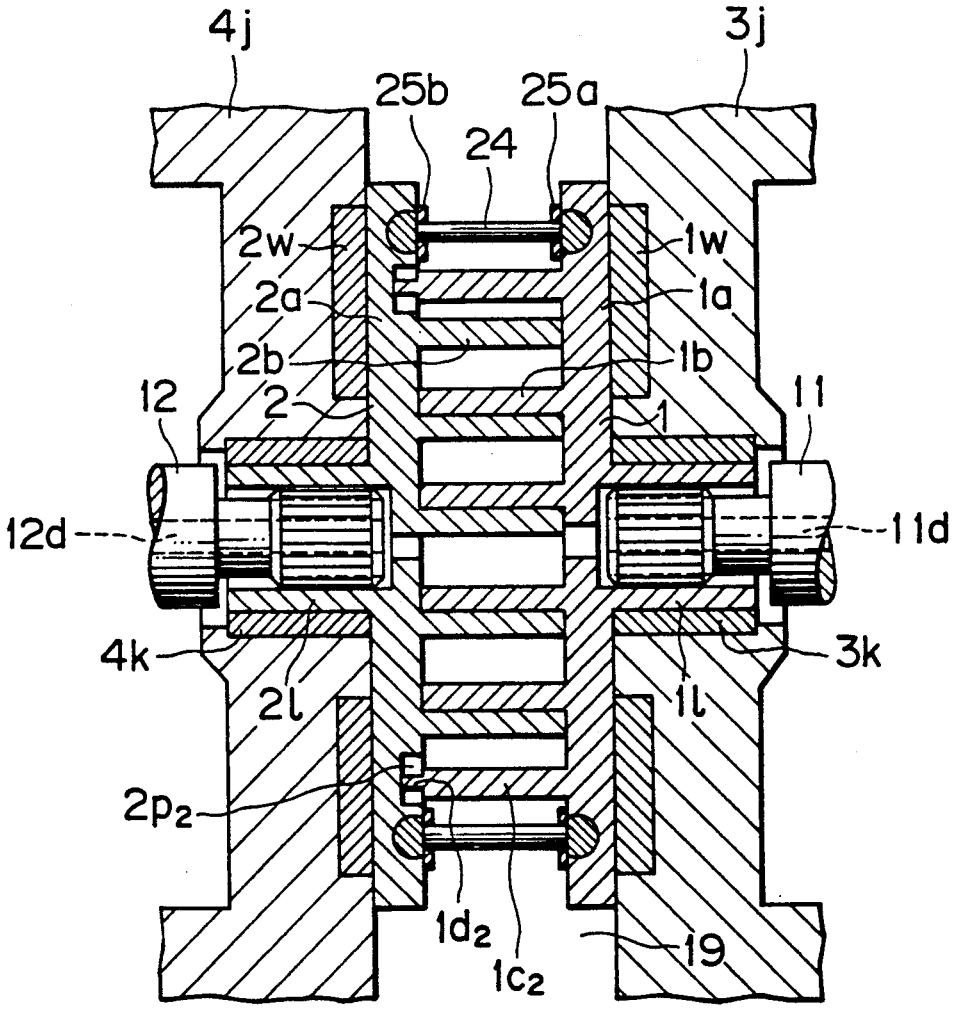
FIG. 15 is a cross-sectional view of a scroll member of a tenth embodiment according to the present invention.

A tenth embodiment of the present invention will be described below with reference to FIG. 15. FIG. 15 is an enlarged view of an engaged portion of the scroll members, showing the structure of the portion of the tenth embodiment corresponding to the central portion of the embodiment shown in FIGS. 1–4. In this embodiment, connecting bars 24 are disposed on the opposed surfaces of the end plates 1a and 2a in order to prevent deformation thereof. Two ends of each of the connecting bars 24 constitute spherical joints. One of the spherical points is slidably connected to the scroll end plate 1a, while the other spherical point is slidably coupled to the scroll end plates 2a. Snap rings 25a, 25b are provided at the coupled portion so that the support bar 24 does not come off in the axial direction. In the figure, one pair of support bars are shown. However, a plurality of connecting bars 24 may be provided on the circumference. First thrust bearings 1w and 2w are dynamic pressure type thrust bearings. These bearings generate thrust forces of pressing the scroll members against each other when the rotational speed is increased. Deformation of the end plates resulting from the generation of such thrust forces is restricted by the support bars 24. The suction pressure space 19 is spatially connected to the outer peripheral portion of the scroll wraps, provision of the flow passages of the working gas being eliminated. Thus, the flow resistance of the working gas can be reduced, and a high-performance compressor can thus be provided.

Figure 16:
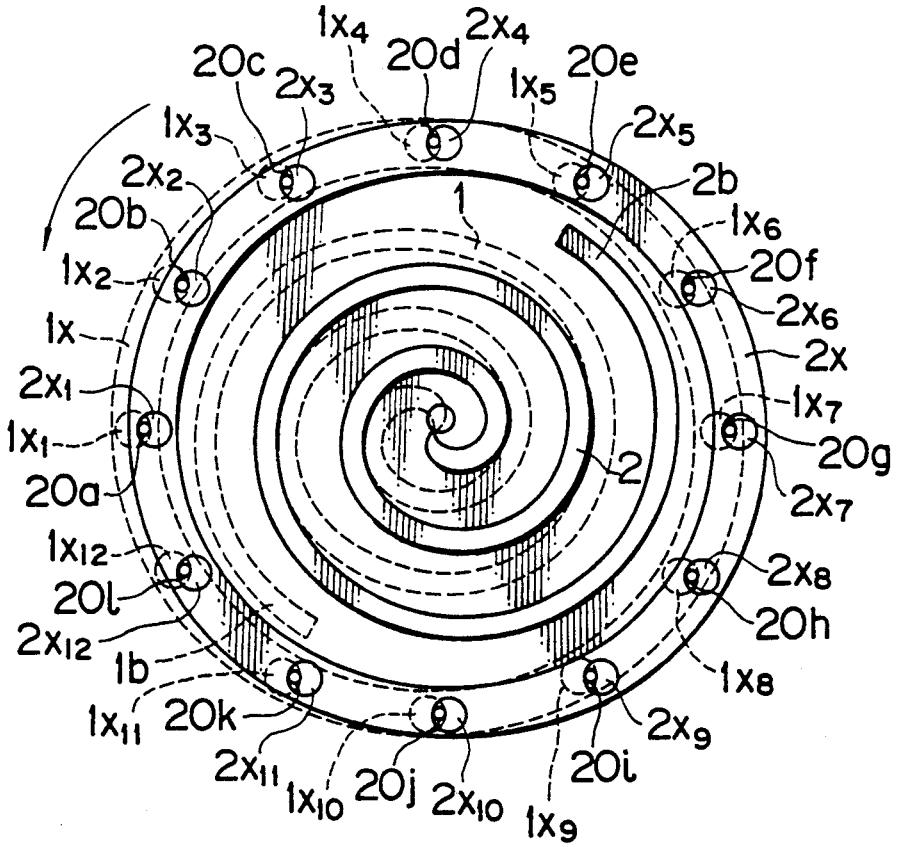
FIG. 16 is a lateral cross-sectional view of a modification of a rotational phase compensation means for maintaining the relative rotational position between the pair of scroll member.
Figure 17:
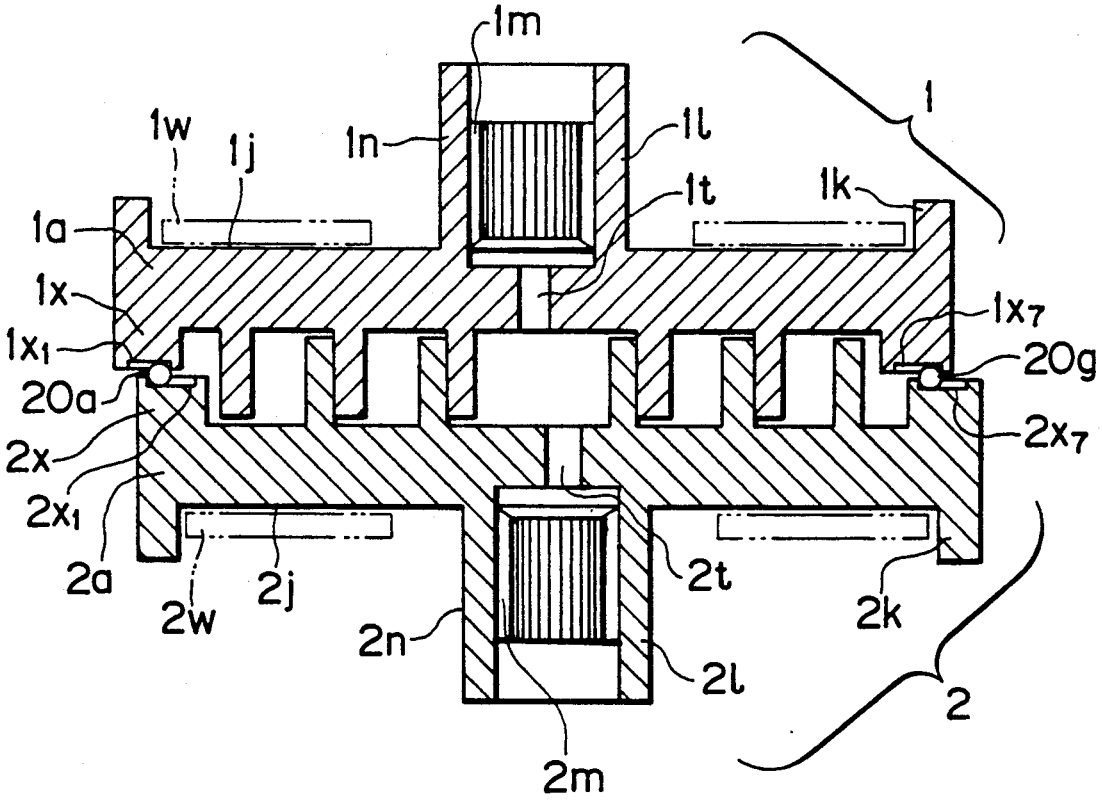
FIG. 17 is a longitudinal cross-sectional view of the rotational phase compensation means of FIG. 16.

Another example of maintaining normal rotational phase relationship between the two scroll members will be described below with reference to FIGS. 16 and 17. FIG. 17 schematically shows how the first and second scroll members are fitted each other. FIG. 17 is a longitudinal cross-section of FIG. 16. In FIG. 16, e.g. as shown in the sixth embodiment, a solid line indicates the second scroll member 2, and a broken line represents the first scroll member 1. In this structure, a ball base 1x, having twelve ball holes $1x_1$ through $1x_{12}$ and projecting from the scroll end plate 1a, and a ball base 2x, having twelve ball holes $2x_1$ through $2x_{12}$ and projecting from the scroll end plate 2a, respectively replace the second thrust bearings 1g and 2g in the sixth embodiment. In this example, the ball bases 1x and 2x are formed integrally with the end plates. However, they may be provided separately from the end plates. When the first scroll 1 and the second scroll 2 are opposed each other and are combined, the ball holes substantially oppose corresponding ball holes, thus forming twelve ball holes. Hence, twelve balls 20a through 20l are disposed in the resultant ball holes in such a manner that they can roll. The ball bases 1x and 2x are made of a relatively hard metal. When the two scroll members are rotated, the balls 20a–20l rotate while making contact with the wall and bottom surfaces of the individual ball holes 1x and 2x, and thereby maintain the relative positional relationship between the two scroll members 1, 2 to a fixed one. Therefore, the rotational phase difference between the first and second scrolls 1, 2 during rotation can be reduced, and displacement of the scroll end plates in a direction in which they move closer to each other is also restricted. In that case, since the contact surface is formed by a ball and a surface, frictional loss due to contact can be reduced, and the efficiency of the compressor can thus be enhanced.

Figure 18:
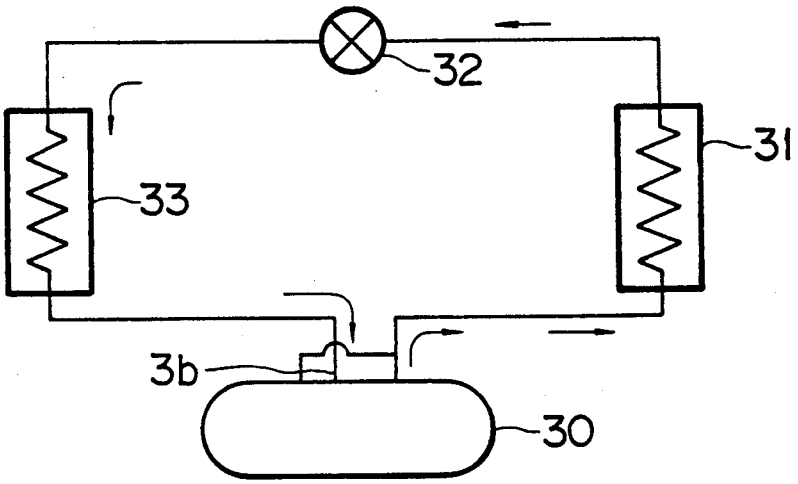
FIG. 18 illustrates the structure of an embodiment of a refrigerating cycle in which a compressor which is the fluid machine according to the present invention is applied to the cycle of a refrigerating air conditioner.

An eleventh embodiment of the present invention in which a compressor is applied to a cycle of a refrigerating and air conditioner will be described below with reference to FIG. 18. FIG. 18 shows how major elements which constitute the cycle of a refrigerating and air conditioner are connected to each other by means of the piping. A refrigerant gas is used as the working gas. A high-temperature high-pressure gas discharged from the discharge ports of the compressor 30 is cooled by a first heat exchanger 31, by which a high-pressure liquid is obtained. This high-pressure liquid undergoes adiabatic expansion when it passes through a throttle valve mechanism 32 and thereby changes into a low-pressure low-temperature steam. A second heat exchanger 33 performs an endothermic operation and a resulting low-pressure gas flows into the suction port 3b of the compressor 30. Thus, heating of the interior of a room is obtained by disposing the first heat exchanger 31 within the room. Arrangement of the second heat exchanger 33 in a room assures cooling of that room. In that case, the two discharge pipes 3*e* and 4*e* of the compressor, shown in the first to fourth embodiments, are connected to each other and are then connected to the refrigerating and air conditioning cycle. Furthermore, since the rotational speed of the compressor can be set over a wide range, as mentioned in the above embodiments, heating or cooling ability can be set over a wide range. Also, since a low-vibration compressor is used, a quiet air conditioner can be provided.

Figure 19:
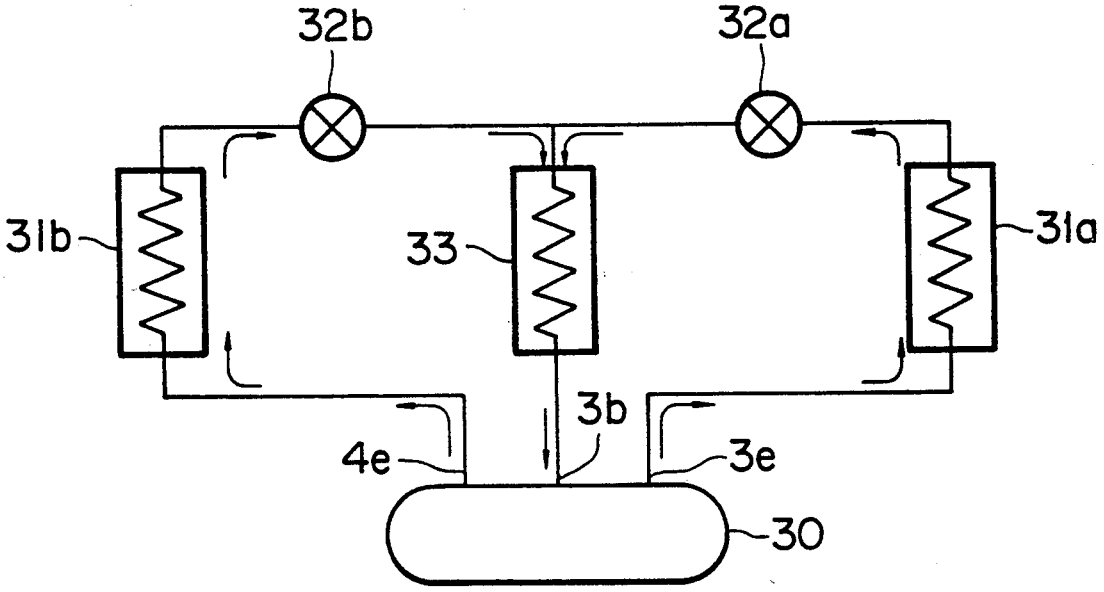
FIG. 19 illustrates the structure of another embodiment of the refrigerating cycle.
Figure 20:
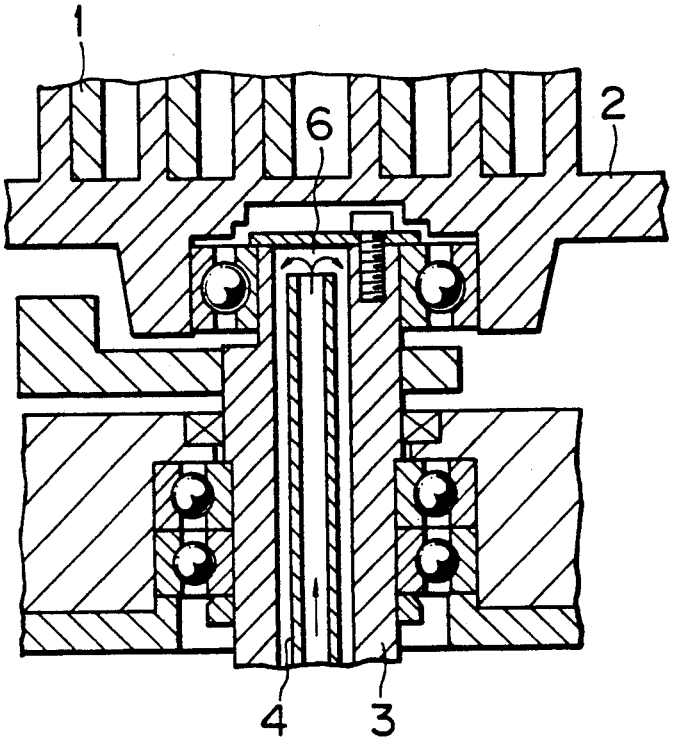
FIG. 20 PRIOR ART
FIG. 20 is a longitudinal cross-sectional view of the essential parts of a conventional scroll member fluid machine.
Figure 21:
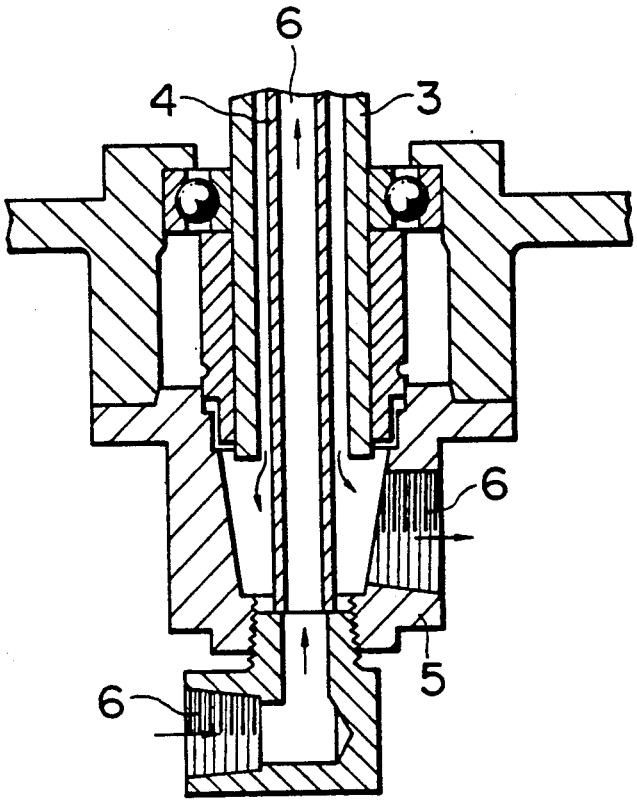
FIG. 21 PRIOR ART
FIG. 21 is a longitudinal cross-sectional view of another essential parts of the conventional scroll fluid machine of FIG. 20.
Figure 22:
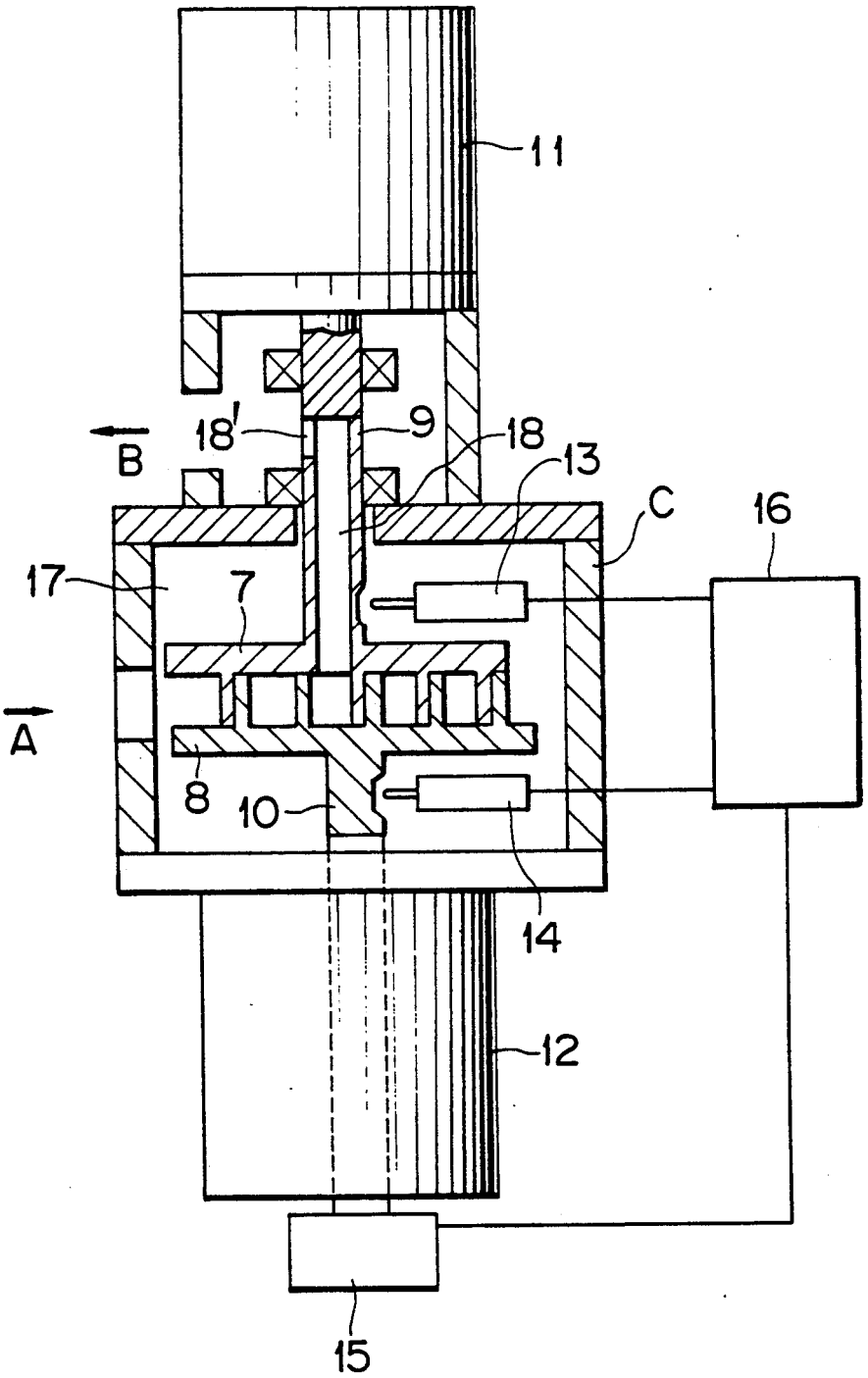
FIG. 22 PRIOR ART
FIG. 22 is a longitudinal cross-sectional view of still another conventional scroll fluid machine.
Figure 23:
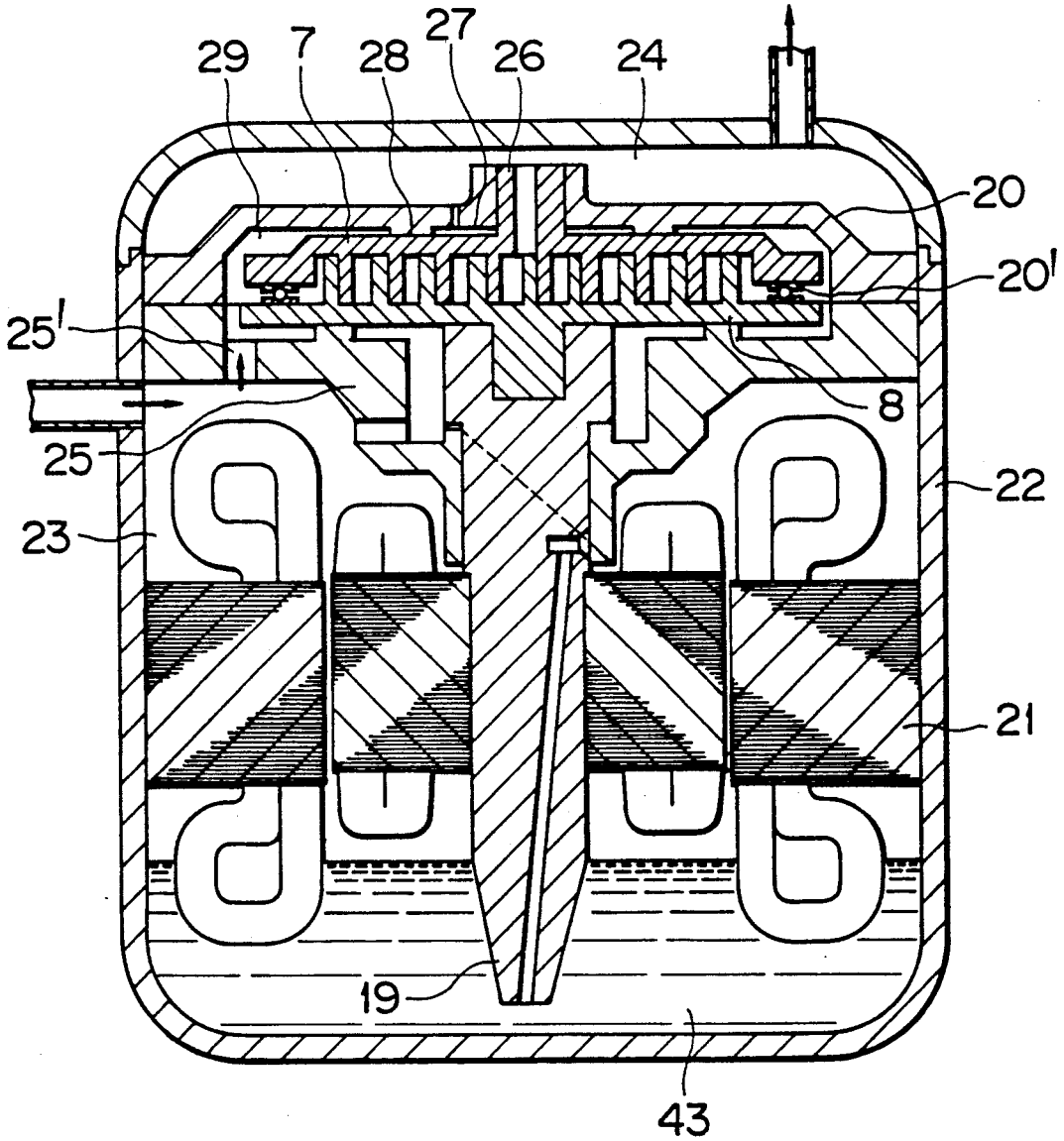
FIG. 23 PRIOR ART
FIG. 23 is a longitudinal cross-sectional view of still another conventional scroll fluid machine.

A twelfth embodiment of the present invention in which the compressor is applied to a cycle of another refrigerating and air conditioner will be described below with reference to FIG. 19. FIG. 19 shows how major elements which constitute the cycle of a refrigerating and air conditioner are connected to each other by means of the piping. A refrigerant gas is used as the working gas. In this embodiment, the two discharge pipes 3*e* and 4*e* of the compressor 30 are respectively connected to high-pressure pipes, which are in turn respectively connected to two first heat exchangers 31*a* and 31*b* and then throttle valve mechanisms 32*a* and 32*b*. In this arrangement, discharge gas of the compressor 30 is divided into two parts within the compressor and the resultant two streams flow into the first heat exchangers 31*a* and 31*b*. After the gas streams pass through the throttle valve mechanisms 32*a* and 32*b*, they are combined into one flow and the combined refrigerant gas then flows into the second heat exchanger 33. Two different rooms can be heated at the same time by disposing the first heat exchangers 31*a* and 31*b* in them. Also, the room can be cooled by disposing reversely arranged second heat exchanger 33 in that room. In that case, since sufficient heat radiation can be ensured by the first heat exchangers 31*a* and 31*b*, the room cooling ability can be enhanced. The heating and cooling abilities can be set over the wide range, and a low-vibration and hence quite compressor can be provided, as in the case of the eleventh embodiment. Furthermore, the first heat exchangers 31*a* and 31*b* can be used for cooling the rooms by incorporating an element, such as a four-way valve or flow-passage change-over valve, in the above-described cycle. Thus, the compressor according to the present invention can be applied to an air conditioner for heating or cooling two different rooms at the same time.

According to the present invention, in the first place, the projecting proportions 1*k*, 2*k* are provided on the rear surface of the first end plate, and it generates a centrifugal force by the rotary motion of the scroll members 1, 2, like the scroll wrap. Therefore, centrifugal forces are exerted to the two surfaces of the end plate as moment loads which cancel each other, and deformation of the scroll end plate can thus be reduced.

Furthermore, when the moment load exerted by the projecting portions 1*k*, 2*k* provided on the rear surface of each of the scroll end plate is smaller than the moment load exerted by the scroll wrap, the projecting portions 1*k*, 2*k* are provided in an outward position in the radial direction or is made of a material having a large specific gravity. Conversely, when the moment exerted by the projecting portion is larger than the moment load, the projecting portions 1*k*, 2*k* are provided on the rear surface of the scroll end plate at an inward position in the radial direction. Thus, the magnitude of the moment load can be adjusting, and deformation of the scroll end plate can thus be further reduced.

Furthermore, the annular projecting portions 1*k*, 2*k* are provided on the rear surface of each of the scroll end plates, and the dynamic pressure type first thrust bearing is provided on the rear surface of each of the end plates of the first and second scroll members 1,2 for restricting displacement of the end plates in a direction in which they move away from each other. Thus, as the rotational speed increases, the thrust support force increases, and the increased thrust supporting force restricts movement of the two scroll members in the thrust direction and thus maintains the normal positional relation between the two scroll members 1, 2. As a result, the compressor can be operated in a state where the posture of the two scroll members 1, 2 are stable, and deformation of the scroll end plate during the high-speed operation can thus be restricted while the gap between the scroll wraps can be maintained normal. The performance of the compressor can thus be enhanced. Furthermore, the second thrust bearing 1*g*, 2*g* for restricting displacement of the scroll end plate in a direction in which the scroll end plates are moved closer to each other in the thrust direction is provided on the surface of each of the scroll end plates on which the scroll wrap is provided in such a manner that it projects from the end plate. Thus, the second thrust bearings 1*g*, 2*g* prevent contact of the forward surface of the first scroll wrap to the bottom surface of the second scroll wrap in the thrust direction, and maintain the gap between the forward surfaces of the scroll wraps small in the axial direction. Also, deformation of the scroll end plate can be restricted, and the clearance between the scroll wraps in the radial direction can thus be maintained in a normal range.

Furthermore, the outer peripheral surface of the annular projecting portions 1*k*, 2*k* formed on the rear surface of the scroll end plate integrally with or separately from the scroll end plate is inclined or is formed in an arc, and the annular projecting portion is fitted into a groove with an adequate gap therebetween. Consequently, outward deformation of the projecting portion resulting from a centrifugal force is received by the tapered surface, and deformation of the scroll end plate in an arc in which the wrap side thereof is protruded can be prevented by the component force in the thrust direction.

Furthermore, the connecting bars 24 are disposed between the opposed surfaces of the pair of scroll end plates for forcibly preventing deformation of the scroll end plates. The two ends of each of the connecting bars are coupled to the respective end plates. Articuate deformation of the scroll end plate can be directly restricted, and curved deformation of the end plate can be restricted. Consequently, the clearance between the scroll wraps in the radial direction can be maintained in a normal range.

In the second place, in the present invention, an annular groove into which the annular projecting portion 1*k*, 2*k* is fitted with an adequate gap therebetween is provided in each of the flames which oppose the scroll end plates, and a lubricating oil is supplied into the annular groove. Thus, the outer peripheral portion of the projecting portion and the inner peripheral portion of the annular grooves have the function of a slide bearing. The outer peripheral portion of the projecting portion is supported by the annular grooves, and deformation of the end plate can be restricted. The liquid, such as a lubricating oil, supplied into the minute gap in the fitted portion between the groove and the projecting portion seals the gap. Thus, leakage of a large amount of high-pressure discharge gas or intermediate pressure into the suction chamber can be prevented, and the performance of the compressor can thus be enhanced.

In one preferred form of the present invention, the first thrust bearing is achieved using the pressure of a fluid. In that case, the pressure of the fluid can be maintained to an appropriate value by the projecting portion 1*k*, 2*k*, and the thrust bearing can thus receive the thrust force exerted to the scroll members 1, 2 sufficiently.

Furthermore, the second thrust bearing 1*g*, 2*g* has a height from the surface of the end plate which ensures that the sum of the heights of the two second thrust bearings 1*g*, 2*g* is substantially equal to or slightly higher than the height of the scroll wrap. Consequently, the gap between the wraps can be maintained to a suitable value, and highly efficient operation can be assured.

In the third place, since the rotary phase compensation means is provided between the scroll end plate and the flame which opposes the scroll end plate, contact between the wraps of the scrolls due to deformation of the end plates can be prevented, and vibrations and noise level can thus be reduced during the high-speed rotation. Furthermore, provision of the rotary phase compensation means makes maintenance of a suitable gap between the scroll wraps easier, and further enhances volume efficiency. Thus, the efficiency of the compressor can be enhanced over a wide speed range, and vibrations and noise level can be reduced.

In the fourth place, the first rotation drive portion for supplying the rotational drive force to the first scroll member 1 and the second rotation drive portion for supplying the rotational drive force to the second scroll member 2 are provided, and the respective rotation drive portions are coupled to the corresponding scrolls through the motor shafts 11, 12 by means of the spline shaft coupling. Consequently, the allowance of the error of the amount of eccentricity between the scroll members can be increased, and machining of the parts can thus be made easy. Also, assembly is made easier because the motor shafts 11, 12 can be coupled each other after the scroll wraps have been engaged with each other.

In the fifth place, a compressor includes first and second scroll members 1, 2 each of which includes an scroll end plate and a scroll wrap projecting from the scroll end plate, and flames provided on the side of the end plates of the first and second scroll members 1, 2 which are remote from the scroll wraps for supporting motor shafts 11, 12 for rotating the first and second scroll members 1, 2. The first and second scroll members 1, 2 are combined with the scroll wraps directed inwardly, and gas in a compression working chamber is compressed and discharged by synchronously rotating the first and second scrolls 1, 2 through the motor shafts 11, 12 in the same direction. A discharge port 1*t*, 2*t* is provided at the central portion of the motor shafts 11, 12 and a discharge chamber connected to the discharge port 1*t*, 2*t* is disposed on each of the two sides of the scroll members 1, 2. Each of the discharge chambers is connected to a first heat exchanger. The first heat exchangers are combined and are then connected to a part having a throttle valve function and then a second heat exchanger to form a refrigerating cycle. Consequently, the first heat exchanger can be disposed in two different rooms. Also, the heating or cooling ability range can be enlarged, and a low-vibration and low-noise level air conditioner can be provided.

What is claimed is:

1. A synchronous rotating type scroll fluid machine, comprising:

a first scroll driven by a shaft of a first motor and having an end plate with front and rear surfaces and a scroll wrap protruding from the front surface of said scroll end plate;

a second scroll driven by a shaft of a second motor and having an end plate with front and rear surfaces and a scroll wrap protruding from the front surface of said scroll end plate;

mounting means for mounting said scroll members such that the axes of said scroll members are offset from each other and that said wraps of said scroll members mesh with each other; and thrust balancing means for attaining a balance between the thrusting forces acting on each said scroll member both at said mounting means and said scroll members in meshing state under a wide range of operating conditions of the synchronous rotating type scroll fluid machine, said thrust balancing means operating by separately discharging a gas compressed by the first and second scrolls to the rear surfaces of the first and second scrolls.

2. A synchronous rotating type scroll fluid machine according to claim 1, wherein said thrust balancing means is provided on at least one of said mounting means and said scroll members.

3. A synchronous rotating type scroll fluid machine, comprising:

a first scroll driven by a shaft of a first motor and having an end plate and a scroll wrap protruding from a surface of said scroll end plate;

a second scroll driven by a shaft of a second motor and having an end plate and a scroll wrap protruding from a surface of said scroll end plate;

mounting means for mounting said scroll members such that the axes of said scroll members are offset from each other and that said wraps of said scroll members mesh with each other; and thrust balancing means for attaining a balance between the thrusting forces acting on each said scroll member both at said mounting means and said scroll members in meshing state under a wide range of operating conditions of the synchronous rotating type scroll fluid machine, wherein said thrust balancing means include means for discharging, through a passage formed in said shaft of said motor for driving each scroll member, the gas compressed between both scroll members in order to cool said first and second motors.

4. A synchronous rotating type scroll fluid machine, comprising: first and second scroll members which are driven by motor shafts of first and second motors, respectively, each of said scroll members having a scroll end plate with a central discharge port and a spiral wrap protruding upright from one surface of said scroll end plate, said scroll members being mounted such that their axes are offset from each other and that their scroll wraps mesh with each other, said motor shafts of said first and second motors driving said first and second scroll members at similar speeds of rotation and in similar directions so that a gas is sucked from a peripheral region of said scroll members and compressed until it is discharged from said central discharge ports, said motor shafts having axial through-bores and being provided on central regions of said first and second scroll members so that said axial through-bores communicate with said central discharge ports, whereby said axial through-bores in said motor shafts serve as passages for discharging compressed gas in order to cool said first and second motors.

5. A synchronous rotating type scroll fluid machine according to claim 4, wherein said first and second motors are respectively encased in hermetic spaces in a hermetic casing, and wherein said hermetic casing is provided with a communication hole which provides communication between said hermetic spaces encasing said first and second scroll members.

6. A synchronous rotating type scroll fluid machine according to one of claims 4 or 5, wherein mechanical thrust bearings are provided for respective scroll members so as to act against a force which is generated by the gas compressed between both scroll members and which acts to separate said first and second scroll members from each other.

7. A synchronous rotating type scroll fluid machine, comprising: first and second scroll members each having an end plate and a scroll wrap protruding upright from one surface of said scroll end plate; a frame having portions disposed on opposite sides of the respective end plates to said scroll wraps and rotatably supporting motor shafts for rotatingly driving said scrolls, said first and second scroll members being assembled together such that said scroll wraps mesh with each other to define compression working chambers, said first and second scroll members being synchronously rotated in the same direction around their geometrical axes of the motor shafts so as to compress a gas in said compression working chambers and to discharge the compressed gas; thrust balancing means for attaining a balance between the thrusting forces acting on each said scroll member in a meshing state under a wide range of operating conditions of the synchronous rotating type scroll fluid machine, said thrust balancing means operating by separately discharging a gas compressed by a first and second scrolls to rear surfaces of the first and second scrolls; said synchronous type rotating scroll fluid machine further comprising dynamic pressure type thrust bearings provided on said frame and bearing axial thrust forces acting on said first and second scroll members.

8. A synchronous rotating type scroll fluid machine, comprising:

a first scroll separate from and driven by a shaft of a first motor and having an end plate and a scroll wrap protruding from a surface of said scroll end plate;

a second scroll separate from and driven by a shaft of a second motor and having an end plate and a scroll wrap protruding from a surface of said scroll end plate;

mounting means for mounting said scroll members such that the axes of said scroll members are offset from each other and that said wraps of said scroll members mesh with each other;

thrust balancing means for attaining a balance between the thrusting forces acting on each said scroll member both at said mounting means and said scroll members in meshing state under a wide range of operating conditions of the synchronous rotating type scroll fluid machine; and means for coupling said first and second scrolls with their respective shafts in an axially movable manner.

* * * * *